US010030461B2

(12) United States Patent
Johansen et al.

(10) Patent No.: US 10,030,461 B2
(45) **Date of Patent: *Jul. 24, 2018**

(54) CONSTRICTING WEDGE DESIGN FOR PRESSURE-RETAINING SEAL

(71) Applicant: FHE USA LLC, Fruita, CO (US)

(72) Inventors: Keith C. Johansen, Fruita, CO (US); Nicolas G. Snoke, Grand Junction, CO (US)

(73) Assignee: FHE USA LLC, Fruita, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/902,203

(22) Filed: Feb. 22, 2018

(65) Prior Publication Data

US 2018/0179846 A1 Jun. 28, 2018

Related U.S. Application Data

(63) Continuation of application No. 15/826,371, filed on Nov. 29, 2017, which is a continuation of application No. 15/615,549, filed on Jun. 6, 2017, now Pat. No. 9,879,496, which is a continuation of application No. 15/371,141, filed on Dec. 6, 2016, now Pat. No. 9,670,745, and a continuation-in-part of application No. 15/341,864, filed on Nov. 2, 2016, now Pat. No. 9,644,443.

(60) Provisional application No. 62/263,889, filed on Dec. 7, 2015.

(51) Int. Cl.
*E21B 33/03* (2006.01)
*E21B 34/02* (2006.01)

(52) U.S. Cl.
CPC ..... *E21B 33/03* (2013.01); *E21B 34/02* (2013.01)

(58) Field of Classification Search
CPC ..... E21B 33/038; E21B 43/013; E21B 17/02; E21B 23/00; E21B 33/03; F16L 37/002; F16L 37/62
See application file for complete search history.

(56) References Cited

U.S. PATENT DOCUMENTS

| | | | |
|---|---|---|---|
| 3,452,815 | A | 7/1969 | Watkins |
| 3,486,556 | A | 12/1969 | Burgess |
| 3,874,706 | A | 4/1975 | Arnold |
| 4,153,278 | A | 5/1979 | Ahlstone |
| 4,441,742 | A | 4/1984 | Owens, III |
| 4,526,406 | A | 7/1985 | Nelson |
| 4,646,827 | A | 3/1987 | Cobb |
| 4,651,830 | A | 3/1987 | Crotwell |
| 5,282,655 | A | 2/1994 | Marietta |
| 6,125,939 | A | 10/2000 | Abreo, Jr. |
| 6,129,149 | A | 10/2000 | Beall |
| 6,609,734 | B1 | 8/2003 | Baugh |
| 8,474,537 | B2 | 7/2013 | Voss et al. |
| 8,511,387 | B2 | 8/2013 | Fraser et al. |

(Continued)

OTHER PUBLICATIONS

Forum Energy Technologies Brochure, "5-1/8 ID×10KSI Hydralic Latch Assembly—Installation/Operation/Maintenance", 24 pages.

*Primary Examiner* — Daniel P Stephenson
(74) *Attorney, Agent, or Firm* — Zeman Mullen & Ford, LLP

(57) ABSTRACT

High pressure seals for pressure control fittings are disclosed, where such pressure control fittings are located at a wellhead, for example. Embodiments of cam lock seals, a spring-driven ball race seal and wedge seals are disclosed.

10 Claims, 28 Drawing Sheets

(56) References Cited

U.S. PATENT DOCUMENTS

| | | | |
|---|---|---|---|
| 9,644,443 | B1 | 5/2017 | Johansen et al. |
| 9,670,745 | B1 | 6/2017 | Johansen et al. |
| 9,879,496 | B2 | 1/2018 | Johansen et al. |
| 2003/0168857 | A1 | 9/2003 | Jennings |
| 2010/0139925 | A1 | 6/2010 | McKay |
| 2011/0025044 | A1 | 2/2011 | McKay |
| 2011/0095526 | A1 | 4/2011 | Vanderford et al. |
| 2012/0222865 | A1 | 9/2012 | Larson et al. |
| 2013/0093179 | A1 | 4/2013 | Jenkins et al. |
| 2013/0341539 | A1 | 12/2013 | Hughes et al. |
| 2014/0144648 | A1 | 5/2014 | McKay |
| 2014/0352944 | A1 | 12/2014 | Devarajan et al. |
| 2015/0083430 | A1 | 3/2015 | Jahnke et al. |
| 2015/0114667 | A1 | 4/2015 | Mansukh et al. |
| 2016/0138352 | A1 | 5/2016 | Leba et al. |
| 2016/0376863 | A1 | 12/2016 | Older et al. |
| 2017/0089162 | A1* | 3/2017 | Barnhart ..... E21B 33/04 |

* cited by examiner

510

950
901
902
910
900
903
951
928
929
923
920
924
925
971
926
970
927
906
952
930
955
904
956

950
901
902
910
900
903
928
929
925
923
951
920
924
971
926
970
927
906
930
904

CONSTRICTING WEDGE DESIGN FOR PRESSURE-RETAINING SEAL

RELATED APPLICATIONS

This application is a continuation of co-pending, commonly-invented, commonly-assigned U.S. non-provisional patent application Ser. No. 15/826,371 filed Nov. 29, 2017, which in turn is a continuation of commonly-invented, commonly-assigned U.S. non-provisional patent application Ser. No. 15/615,549 filed Jun. 6, 2017 (now U.S. Pat. No. 9,879,496), which in turn is a continuation of commonly-invented, commonly-assigned U.S. non-provisional patent application Ser. No. 15/371,141 filed Dec. 6, 2016 (now U.S. Pat. No. 9,670,745), which in turn claims the benefit of, and priority to, commonly-invented and commonly-assigned U.S. provisional patent application Ser. No. 62/263,889 filed Dec. 7, 2015. Application Ser. No. 15/371,141 is also a continuation-in-part of commonly-invented and commonly-assigned U.S. non-provisional application Ser. No. 15/341,864 filed Nov. 2, 2016 (now U.S. Pat. No. 9,644,443), which also claims priority to 62/263,889. The entire disclosures of 62/263,889, Ser. Nos. 15/341,864, 15/371,141, 15/615,549 and 15/826,371 are incorporated herein by reference.

FIELD OF THE DISCLOSURE

This disclosure is directed generally to pressure control equipment at the wellhead, and more specifically to a remotely-operated wellhead pressure control apparatus. Broadly, and without limiting the scope of this disclosure, one embodiment of the disclosed pressure control apparatus is a cam-locking wellhead attachment that can secure a connection to a pressurized wellhead connection remotely, without manual interaction at the wellhead. Additional embodiments of other innovative high pressure seals for wellhead pressure control fittings are also disclosed.

BACKGROUND OF THE DISCLOSED TECHNOLOGY

Conventionally, wellhead connections to pressure control equipment are typically made by either a hand union or hammer union. Wellhead operators engaging or disengaging these conventional types of wellhead connections place themselves in danger of injury. The pressure control equipment to be connected to the wellhead is typically heavy, and remains suspended above the wellhead operator via use of a crane. Interacting with the crane operator, a technician at the wellhead below must struggle with the suspended load as it is lowered in order to achieve the proper entry angle into the wellhead to make a secure connection. The wellhead operator must then connect the wellhead to the pressure control equipment to the wellhead, typically via a bolted flanged connection. The bolts must be tightened manually by a person at the wellhead, typically via a "knock wrench" struck with a sledgehammer in order to get the bolts sufficiently tight to withstand the internal operating pressure. During this whole process, as noted, the operator is in physical danger of injuries, such as collision with the suspended pressure control equipment load, or pinched or crushed fingers and hands when securing the connection.

Wellhead operators are exposed to similar risks of injury during conventional removal of the pressure control equipment from the wellhead. The removal process is substantially the reverse of the engagement process described in the previous paragraph.

There is therefore a need in the well services industry to have a way to safely connect and disconnect pressure control equipment from the wellhead while minimizing the physical danger to human resources in the vicinity. The disclosed embodiments of high pressure seals for wellhead pressure control fittings are all hydraulically-actuated and -deactuated systems that lock pressure control equipment to the wellhead via a remote control station.

SUMMARY AND TECHNICAL ADVANTAGES

These and other drawbacks in the prior art are addressed by the disclosed embodiments of high pressure seals for wellhead pressure control fittings. Disclosed embodiments include a cam lock design with a secondary lock, in which the cam lock pressure control apparatus replaces connections done conventionally either by hammering, torqueing, or with a quick union nut, all of which require the interaction of an operator to perform these operations. This disclosure describes exemplary cam lock embodiments in both larger and smaller diameter configurations to suit corresponding size ranges of wellheads. In such embodiments, a crane operator may place pressure control equipment (PCE) directly onto the wellhead via the apparatus's highly visible entry guide ("tulip"). The crane operator may then proceed to actuate the cam lock control apparatus and secure the pressure control equipment in embodiments where the crane is equipped with the apparatus's remote controls. In alternative embodiments, a second operator may operate the cam lock control apparatus remotely while the crane holds the pressure control equipment in the tulip. In currently preferred embodiments, the disclosed cam lock pressure control apparatus allows the pressure control equipment to be secured in the wellhead from up to 100 feet away from the wellhead, although the scope of this disclosure is not limited in this regard.

As noted, disclosed embodiments of the disclosed cam lock pressure control apparatus provide a secondary mechanical lock feature that holds the locked pressure connection secure without total loss in hydraulic pressure. Preferably, the apparatus may be adapted to fit any conventional wellhead, and may be available in several sizes, such as (without limitation) for 3-inch to 7-inch pipe. As noted, this disclosure describes exemplary cam lock embodiments in both larger and smaller diameter configurations to suit corresponding size ranges of wellheads. Although not limited to any particular pressure rating, the disclosed cam lock pressure control apparatus is preferably rated up to about 15,000 psi MAWP (maximum allowable working pressure). Although the embodiments described in this disclosure are described for applications in the oilfield industry, the disclosed cam lock pressure control apparatus is not limited to such applications. It will be appreciated that the apparatus also has applications wherever highly pressurized joint connections can be made more safely by remote actuation and deactuation.

Embodiments of the disclosed pressure control apparatus preferably also provide a "nightcap" option to cap the well if there will be multiple operations. Consistent with conventional practice in the field, the apparatus includes a nightcap option, available separately, for sealing off the wellhead while the PCE has been temporarily removed, such as at the end of the day. Embodiments including the nightcap enable the apparatus to remain connected to the wellhead, and wellhead pressure to be retained, in periods when PCE is temporarily removed. In such embodiments, the disclosed pressure control apparatus does not have to be removed and re-installed on the well head every time PCE is removed. Such embodiments obviate the need to suspend wellhead operations unnecessarily just to remove and re-install the apparatus every time PCE is removed.

It is therefore a technical advantage of the disclosed pressure control apparatus to reduce substantially the possibility of personal injury to wellhead operators during engagement and disengagement of pressure control equipment from wellheads. In addition to the paramount importance of providing a safe workplace, there are further ancillary advantages provided by the disclosed pressure control apparatus, such as improved personnel morale and economic advantages through reduction of lost time accidents and increased efficiency gains of more rapid rig ups.

Another technical advantage of the disclosed pressure control apparatus is that it provides a hands-free, secure, predictable connection between pressure control equipment and the wellhead. The disclosed primary cam-lock, in combination with the secondary lock feature, provides a predictable serviceably-tight connection every time. This is distinction to possible variances in the tightness provided by conventional hand- and knock wrench-tightening of the connection, whose degree of tightness may vary according to the technique and physical strength of the manual operator.

A further technical advantage of the disclosed pressure control apparatus is that, in embodiments in which a quick test port is provided, a conventional hand pump can conveniently deliver high pressure fluid to a portion of the pressure connection sealed between two sets of o-rings. It will be appreciated that the o-rings will limit or impede high pressure fluid flow into or out of the portion of the pressure connection between the two sets of o-rings. Embodiments of this disclosure provide a quick test port though the pressure control assembly into the flow-limited portion of the pressure connection. A hand pump may then be used to deliver fluid through the quick test port to the flow-limited portion. This allows the pressure integrity of the seals provided by the o-rings to be tested prior to applying high fluid pressures from the wellhead onto the pressure control apparatus's pressure connection. In other applications, the quick test port may be used to equalize pressure in the flow-limited portion of the pressure connection during service engagement and disengagement of the pressure control apparatus from the wellhead.

Disclosed additional embodiments of high pressure seals for wellhead pressure control fittings describe a wedge seal design and a spring-driven ball race seal design that substitute for the cam lock design. The wedge seal design and spring-driven ball race seal design differentiate functionally over the cam lock design primarily in the mechanism by which a high pressure seal is provided. The cam design provides piston-actuated rotating cams whose perimeter curvatures bear down on a shaped shoulder formed in the exterior surface of a PCE adapter. The adapter is received into a receptacle assembly connected to the wellhead, so that the cams compress the adapter into the receptacle to form a high pressure seal. By contrast, the wedge seal design provides opposing sliding wedges. Opposing sloped sides on the wedges slide together in reciprocating motion responsive to hydraulic pressure, causing the PCE adapter to be compressed into the wellhead assembly to form a high pressure seal. By contrast again, the spring-driven ball race seal design compresses the PCE adapter into the wellhead assembly by forcing, again responsive to hydraulic pressure, an annular member over a cylindrical ball race and into a tight fit (1) inside an annular receptacle, and (2) between ball bearings in the ball race and receiving grooves in the adapter. Similar to the cam lock design, the wedge seal design and spring-driven ball race seal design are both also remotely actuated and deactuated via hydraulic control, and therefore provide many of the same technical advantages described above.

According to a first cam lock aspect, therefore, this disclosure describes embodiments of a wellhead pressure control fitting comprising a generally tubular Pressure Control Equipment (PCE) adapter having first and second adapter ends, the first adapter end contoured to mate with pressure control equipment, the second adapter end providing a shaped end including an adapter end curvature; a generally tubular pressure control assembly having first and second assembly ends, the first assembly end providing a first assembly end interior and a first assembly end exterior, the second assembly end configured to mate with a wellhead; the first assembly end exterior having an exterior periphery, the exterior periphery providing a plurality of cam locks, each cam lock disposed to rotate about a corresponding cam lock pin, each cam lock pin anchored to the first assembly end exterior, each cam lock further providing a cam perimeter curvature; the first assembly end exterior further providing a plurality of cam lock pistons, one cam lock piston for each cam lock, wherein extension and retraction of the cam lock pistons causes rotation of the cam locks in opposing directions about their corresponding cam lock pins; the first assembly end exterior further providing a plurality of locking ring pistons, a locking ring connected to the locking ring pistons at a distal end thereof; the locking ring encircling the first assembly end proximate the cam locks, wherein extension of the locking ring pistons causes the locking ring to move to a position free of contact with the cam locks as the cam locks rotate about the cam lock pins, and wherein retraction of the locking ring pistons causes the locking ring to move so as to restrain the cam locks from rotation about the cam lock pins; the first assembly end interior providing a receptacle for receiving the second adapter end, the second adapter end and the receptacle further each providing cooperating abutment surfaces, the cooperating abutment surfaces forming a high pressure seal between the second adapter end and the receptacle when the second adapter end is compressively received into the receptacle; wherein, as the second adapter end enters the receptacle and engages the cooperating abutment surfaces, extension of the cam lock pistons causes the cam locks to rotate about the cam lock pins, which in turn causes the cam perimeter curvatures on the cam locks to cooperatively bear down on the adapter end curvature, which in turn compresses the second adapter end into the receptacle to form the high pressure seal; and wherein, once the high pressure seal is formed, retraction of the locking ring pistons causes the locking ring to move so as to restrain the cam locks from rotation about the cam lock pins.

In a second cam lock aspect, embodiments of the wellhead pressure control fitting include that each cam lock further provides a cam perimeter notch, each cam perimeter notch configured to engage the second adapter end as the second adapter end approaches entry into the receptacle.

In a third cam lock aspect, embodiments of the wellhead pressure control fitting include that the second assembly end further provides a vent line.

In a fourth cam lock aspect, embodiments of the wellhead pressure control fitting include that the second adapter end provides at least one o-ring seal configured to mate with the receptacle when the second adapter end is received into the receptacle.

In a fifth cam lock aspect, embodiments of the wellhead pressure control fitting include that the second adapter end provides at least first and second o-ring seals, and in which the first assembly end further provides a quick test port, the quick test port comprising a fluid passageway from the first assembly end exterior through to the first assembly end interior, wherein the quick test port is open to the first assembly end interior at a location selected to lie between the first and second o-ring seals when the second end adapter and the receptacle form the high pressure seal.

In a sixth cam lock aspect, embodiments of the wellhead pressure control fitting include that the locking ring is in an interference fit with the cam locks when retraction of the locking ring pistons causes the locking ring to move so as to restrain the cam locks from rotation about the cam lock pins.

In a seventh cam lock aspect, embodiments of the wellhead pressure control fitting include that each cam lock piston is connected to its corresponding cam lock via a pinned cam linkage, each pinned cam linkage including a link arm interposed between the cam lock piston and cam lock, each link arm connected to the cam lock via a first linkage pin, each link arm connected to the cam lock piston by a second linkage pin.

In an eighth cam lock aspect, embodiments of the wellhead pressure control fitting include that the cooperating abutment surfaces include a machined shoulder surface and a machined slope surface provided on the second adapter end, the receptacle further providing machined surfaces to mate with the shoulder surface and slope surface in forming the high pressure seal.

In a ninth cam lock aspect, embodiments of the wellhead pressure control fitting include that the PCE adapter is interchangeable with a generally tubular night cap adapter, the night cap adapter having first and second night cap ends, wherein the first night cap end is closed and sealed off against internal pressure, and wherein the second night cap end is dimensionally identical to the second adapter end on the PCE adapter.

According to a first aspect of the disclosed additional embodiments of high pressure seals for wellhead pressure control fittings, therefore, this disclosure describes embodiments of a wellhead pressure control fitting comprising a generally tubular Pressure Control Equipment (PCE) adapter having first and second adapter ends, the first adapter end configured to mate with pressure control equipment, the second adapter end providing an annular first adapter rib, a generally tubular pressure control assembly having first and second assembly ends and a longitudinal centerline, the centerline defining axial displacement parallel to the centerline and radial displacement perpendicular to the centerline, the first assembly end providing a first assembly end interior, the second assembly end configured to mate with a wellhead, the first assembly end interior providing a PCE receptacle for receiving the second adapter end, the second adapter end and the PCE receptacle further each providing cooperating abutment surfaces, the cooperating abutment surfaces forming a pressure seal between the second adapter end and the PCE receptacle when the second adapter end is compressively received into the PCE receptacle, the first assembly end interior further providing a lower wedge assembly, the lower wedge assembly including a plurality of lower wedges, each lower wedge having first and second opposing lower wedge sides, each first lower wedge side providing protruding top and bottom lower wedge ribs, a generally hollow lower wedge receptacle, the lower wedge receptacle further providing a plurality of shaped lower wedge receptacle recesses formed in an interior thereof one lower wedge receptacle recess for each lower wedge, the lower wedge receptacle further having first and second opposing lower wedge receptacle sides in which the lower wedge receptacle recesses define the first lower wedge receptacle side, and wherein each lower wedge is received into a corresponding lower wedge receptacle recess so that the first lower wedge receptacle side and the second lower wedge sides provide opposing sloped lower wedge surfaces, wherein axial displacement of the lower wedge receptacle relative to the lower wedges causes corresponding radial displacement of the lower wedges, and wherein, as the second adapter end enters the PCE receptacle and engages the cooperating abutment surfaces, axial displacement of the lower wedge receptacle relative to the lower wedges causes corresponding radial constriction of the top and bottom lower wedge ribs around the first adapter rib and the PCE receptacle, which in turn compresses the second adapter end into the PCE receptacle to form the pressure seal.

In a second aspect of additional seals, embodiments of the wellhead pressure control fitting include that axial displacement of the lower wedge receptacle relative to the lower wedges is enabled by hydraulically-actuated forces exerted against the second lower wedge receptacle side by a hydraulic mechanism selected from the group consisting of (a) a plurality of cooperating hydraulically-pressurized lower chambers acting on the lower wedge receptacle, and (b) at least one extensible and retractable hydraulic lower piston acting on the lower wedge receptacle.

In a third aspect of additional seals, embodiments of the wellhead pressure control fitting include that the adapter provides an annular second adapter rib distal from the first adapter rib towards the first adapter end, and in which the first assembly end interior further provides an upper wedge assembly, the upper wedge assembly including a plurality of upper wedges, each upper wedge having first and second opposing upper wedge sides, each first upper wedge side providing protruding top and bottom upper wedge ribs, a generally hollow upper wedge receptacle, the upper wedge receptacle further providing a plurality of shaped upper wedge receptacle recesses formed in an interior thereof, one upper wedge receptacle recess for each upper wedge, the upper wedge receptacle further having first and second opposing upper wedge receptacle sides in which the upper wedge receptacle recesses define the first upper wedge receptacle side, and wherein each upper wedge is received into a corresponding upper wedge receptacle recess so that the first upper wedge receptacle side and the second upper wedge sides provide opposing sloped upper wedge surfaces, wherein axial displacement of the upper wedge receptacle relative to the upper wedges causes corresponding radial displacement of the upper wedges, and wherein, as the second adapter end enters the PCE receptacle and engages the cooperating abutment surfaces, axial displacement of the upper wedge receptacle relative to the upper wedges causes corresponding radial constriction of the top and bottom upper wedge ribs around the second adapter rib, which in turn restrains the adapter from axial displacement relative to the PCE receptacle.

In a fourth aspect of additional seals, embodiments of the wellhead pressure control fitting include that axial displacement of the upper wedge receptacle relative to the upper wedges is enabled by hydraulically-actuated forces exerted against the second upper wedge receptacle side by a hydraulic mechanism selected from the group consisting of (a) a plurality of cooperating hydraulically-pressurized upper chambers acting on the upper wedge receptacle, and (b) at least one extensible and retractable hydraulic upper piston acting on the upper wedge receptacle.

In a fifth aspect of additional seals, embodiments of the wellhead pressure control fitting include that the upper and lower wedge assemblies operate independently.

In a sixth aspect of additional seals, embodiments of the wellhead pressure control fitting include that the cooperating abutment surfaces include a machined shoulder surface and a machined slope surface provided on the second adapter end, the PCE receptacle further providing machined surfaces to mate with the shoulder surface and slope surface in forming the pressure seal.

In a seventh aspect of additional seals, embodiments of the wellhead pressure control fitting comprise a generally tubular Pressure Control Equipment (PCE) adapter having first and second adapter ends, the first adapter end configured to mate with pressure control equipment, the adapter providing an annular adapter rib distal from the first adapter end towards the second adapter end, a generally tubular pressure control assembly having first and second assembly ends and a longitudinal centerline, the centerline defining axial displacement parallel to the centerline and radial displacement perpendicular to the centerline, the first assembly end providing a first assembly end interior, the second assembly end configured to mate with a wellhead, the first assembly end interior providing a PCE receptacle for receiving the second adapter end, the second adapter end and the PCE receptacle further each providing cooperating abutment surfaces, the cooperating abutment surfaces forming a pressure seal between the second adapter end and the PCE receptacle when the second adapter end is received into the PCE receptacle, the first assembly end interior further providing a wedge assembly, the wedge assembly including a plurality of wedges, each wedge having first and second opposing wedge sides, each first wedge side providing protruding top and bottom wedge ribs, a generally hollow wedge receptacle, the wedge receptacle further providing a plurality of shaped wedge receptacle recesses formed in an interior thereof, one wedge receptacle recess for each wedge, the wedge receptacle further having first and second opposing wedge receptacle sides in which the wedge receptacle recesses define the first wedge receptacle side, and wherein each wedge is received into a corresponding wedge receptacle recess so that the first wedge receptacle side and the second wedge sides provide opposing sloped wedge surfaces, wherein axial displacement of the upper receptacle relative to the wedges causes corresponding radial displacement of the wedges, and wherein, as the second adapter end enters the PCE receptacle and engages the cooperating abutment surfaces, axial displacement of the wedge receptacle relative to the wedges causes corresponding radial constriction of the top and bottom wedge ribs around the adapter rib, which in turn restrains the adapter from axial displacement relative to the PCE receptacle.

In an eighth aspect of additional seals, embodiments of the wellhead press are control fitting include that axial displacement of the wedge receptacle relative to the wedges is enabled by hydraulically-actuated forces, exerted against the second wedge receptacle side by a hydraulic mechanism selected from the group consisting of (a) a plurality of cooperating hydraulically-pressurized chambers acting on the wedge receptacle, and (b) at least one extensible and retractable hydraulic piston, acting on the wedge receptacle.

In a ninth aspect of additional seals, embodiments of the wellhead pressure control fitting comprise a generally tubular Pressure Control Equipment (PCE) adapter having first and second adapter ends, the first adapter end configured to mate with pressure control equipment, an elongate adapter sealing portion formed on the second adapter end, a generally tubular receptacle, the receptacle having first and second receptacle ends, the second receptacle end configured to mate with a wellhead, an elongate receptacle sealing portion formed on the first receptacle end, wherein a pressure seal is formed between the adapter sealing portion and the receptacle sealing portion when the adapter sealing portion is fully received over the receptacle sealing portion and constrained radially outwards, a generally tubular lower body, the lower body having first and second lower body ends, the lower body received over the receptacle and rigidly affixed to the receptacle at the lower body second end, the first lower body end extending parallel with the receptacle sealing portion and positioned to constrain the adapter portion radially when the adapter sealing portion is fully received over the receptacle sealing portion, a generally cylindrical ball race, the ball race having first and second ball race ends, the ball race providing a plurality of holes in a circumferential pattern proximate the second ball race end, the ball race positioned such that the second ball race end contacts the first lower body end, a plurality of ball bearings each received from outside the ball race into a corresponding hole, the holes each having a hole diameter such that the ball bearings protrude through the holes without passing through the holes while still allowing the ball bearings to roll freely as received in the holes, at least one annular adapter groove formed on an exterior of the adapter, the adapter groove positioned and shaped to receive the ball bearings through the ball race holes when the adapter sealing portion is fully received over the receptacle sealing portion, wherein the adapter sealing portion and the receptor sealing portion are locked in sealing engagement when the ball bearings are compressed radially into the adapter groove, a generally tubular floating member, the floating member having first and second floating member ends, the floating member received over the ball race and the lower body, wherein an interior of the first floating member end is in rolling engagement with the ball bearings while retaining the ball bearings in their holes, and wherein an interior of the second floating member end is in sliding sealing engagement with an exterior of the first lower body end, a generally tubular sleeve, the sleeve having first and second sleeve ends, the sleeve received over the ball race, the floating member and the lower body wherein the an exterior of the second floating member end is in sliding sealing engagement with an interior of the sleeve, the second sleeve end rigidly and sealingly affixed to the lower body at the lower body second end so as to create a lower chamber below the second floating member end, the first sleeve end rigidly and sealingly affixed to the ball race so as to create an upper chamber above the first floating member end, wherein hydraulic pressure introduced into the upper chamber encourages the floating member to slide towards the second sleeve end, which in turn causes a thicker portion of the floating member to compress the ball bearings radially, and wherein, hydraulic pressure introduced the lower chamber encourages the floating member to slide towards the first sleeve end, which in turn causes a thinner portion of the floating member to release the ball bearings from radial compression.

In a tenth aspect of additional seals, embodiments of the wellhead pressure control fitting further at least one o-ring on an exterior of the receptacle sealing portion.

The foregoing has outlined rather broadly some of the features and technical advantages of the technology embodied on the disclosed high pressure seals for wellhead pressure control fittings, in order that the detailed description that follows may be better understood. Additional features and advantages of the disclosed technology may be described. It should be appreciated by those skilled in the art that the conception and the specific embodiments disclosed may be readily utilized as a basis for modifying or designing other structures for carrying out the same inventive purposes of the disclosed technology, and that these equivalent constructions do not depart from the spirit and scope of the technology as described and as set forth in the appended claims.

BRIEF DESCRIPTION OF THE DRAWINGS

For a more complete understanding of embodiments described in detail below, and the advantages thereof, reference is now made to the following drawings, in which:

FIGS. 2 through 17 are illustrations depicting details and aspects of two currently preferred embodiments of pressure control assemblies 200 and 600 according to a cam lock design and operating according to FIG. 1, in which FIGS. 2 through 11 are freeze-frame illustrations in sequence, and in which further:

FIGS. 2 and 3 are perspective freeze-frame illustrations depicting adapter 50 approaching entry into pressure control assembly 200;

FIGS. 4 and 5 are elevation freeze-frames illustrations (unsectioned and partial cutaway views, respectively) depicting an upper portion of pressure control assembly 200, prior to entry of adapter 250;

FIGS. 6 and 7 are freeze-frame partial cutaway views depicting the entry of adapter 250 into the upper portion of pressure control assembly 200;

FIGS. 8 through 10 are magnified freeze-frame partial cutaway views of pressure control assembly 200 as adapter 250 engages its seat in receptacle 260;

FIG. 11 is a freeze-frame illustration depicting disengagement of adapter 250 from its seat in receptacle 260;

FIGS. 12 and 13 are perspective freeze-frame illustrations depicting night cap 270 entering and engaging upon pressure control assembly 200;

FIGS. 13 to 15 depict quick test ports 500 and associated manifold box 510 provided on pressure control assembly 200, wherein FIG. 13 is a perspective view of pressure control assembly 200, FIG. 14 is a section as shown on FIG. 12, and FIG. 15 is a magnified cutaway view of manifold box 510;

FIGS. 16 and 17 illustrate one embodiment of a smaller cam lock design than as shown on FIGS. 1 through 15, in which FIG. 16 is a perspective cutaway view and FIG. 17 is an exploded view;

FIGS. 18 through 20 illustrate one embodiment of a spring-driven ball race seal designed to provide a high pressure seal for wellhead pressure control fittings, in which FIG. 18 is a perspective cutaway view, FIG. 20 is an exploded view; and FIGS. 21 through 28 illustrate two embodiments of a wedge seal, each also designed to provide a high pressure seal for wellhead pressure control fittings, in which FIGS. 21 through 24 illustrate a first wedge seal embodiment and FIGS. 25 through 28 illustrate a second wedge seal embodiment; and in which further:

FIG. 21 is a perspective cutaway view of the first wedge seal embodiment;

FIG. 24 is an exploded view of the first wedge seal embodiment;

FIG. 25 is a perspective cutaway view of the second wedge seal embodiment;

FIG. 28 is an exploded view of the second wedge seal embodiment.

DETAILED DESCRIPTION

Reference is now made to FIGS. 1 through 28 in describing the currently preferred embodiments of the disclosed pressure control assemblies. For the purposes of the following disclosure, FIGS. 1 through 28 should be viewed together. Any part, item, or feature that is identified by part number on one of FIGS. 1 through 28 will have the same part number when illustrated on another of FIGS. 1 through 28. It will be understood that the embodiments as illustrated and described with respect to FIGS. 1 through 28 are exemplary, and the scope of the inventive material set forth in this disclosure is not limited to such illustrated and described embodiments.

Figure 16:
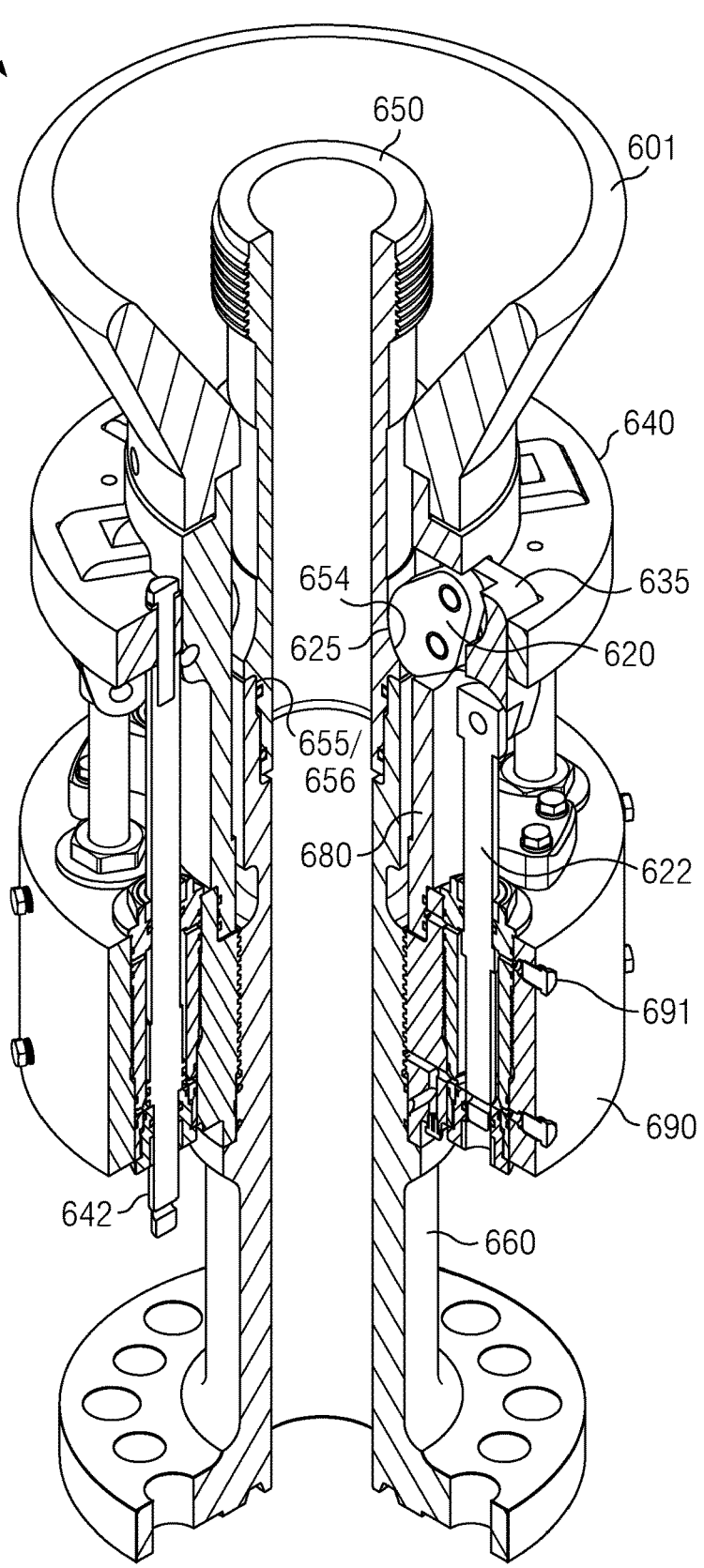
Figure 17:
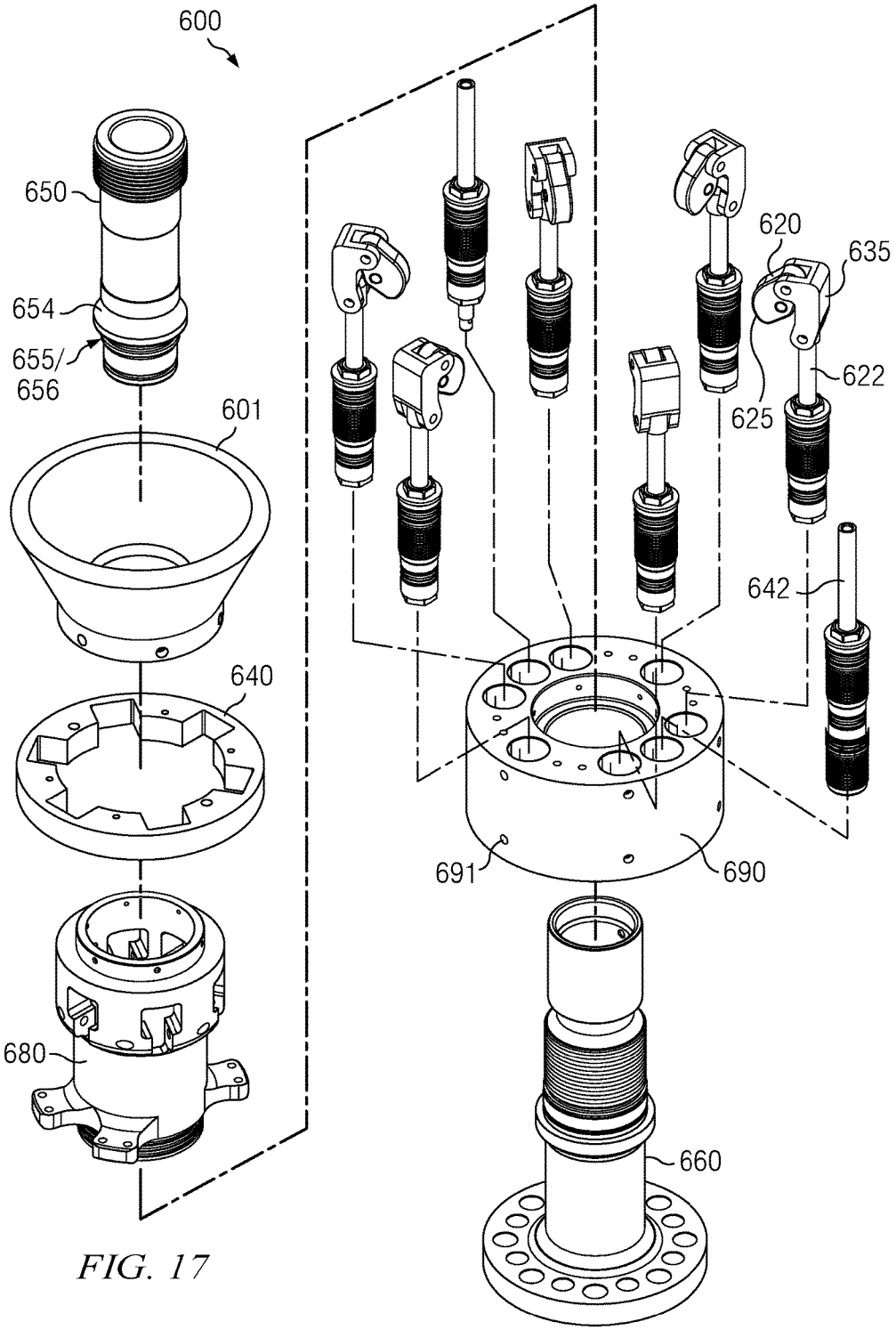

FIGS. 1 through 17 illustrate two cam lock embodiments of the disclosed technology. As noted above in the "Summary" section, cam lock embodiments include a cam lock mechanism. FIGS. 1 through 15 illustrate one embodiment of a larger cam lock design, suitable for larger diameter wellheads. FIGS. 16 and 17 illustrate one embodiment of a smaller cam lock design, suitable for smaller wellheads.

Figure 18:
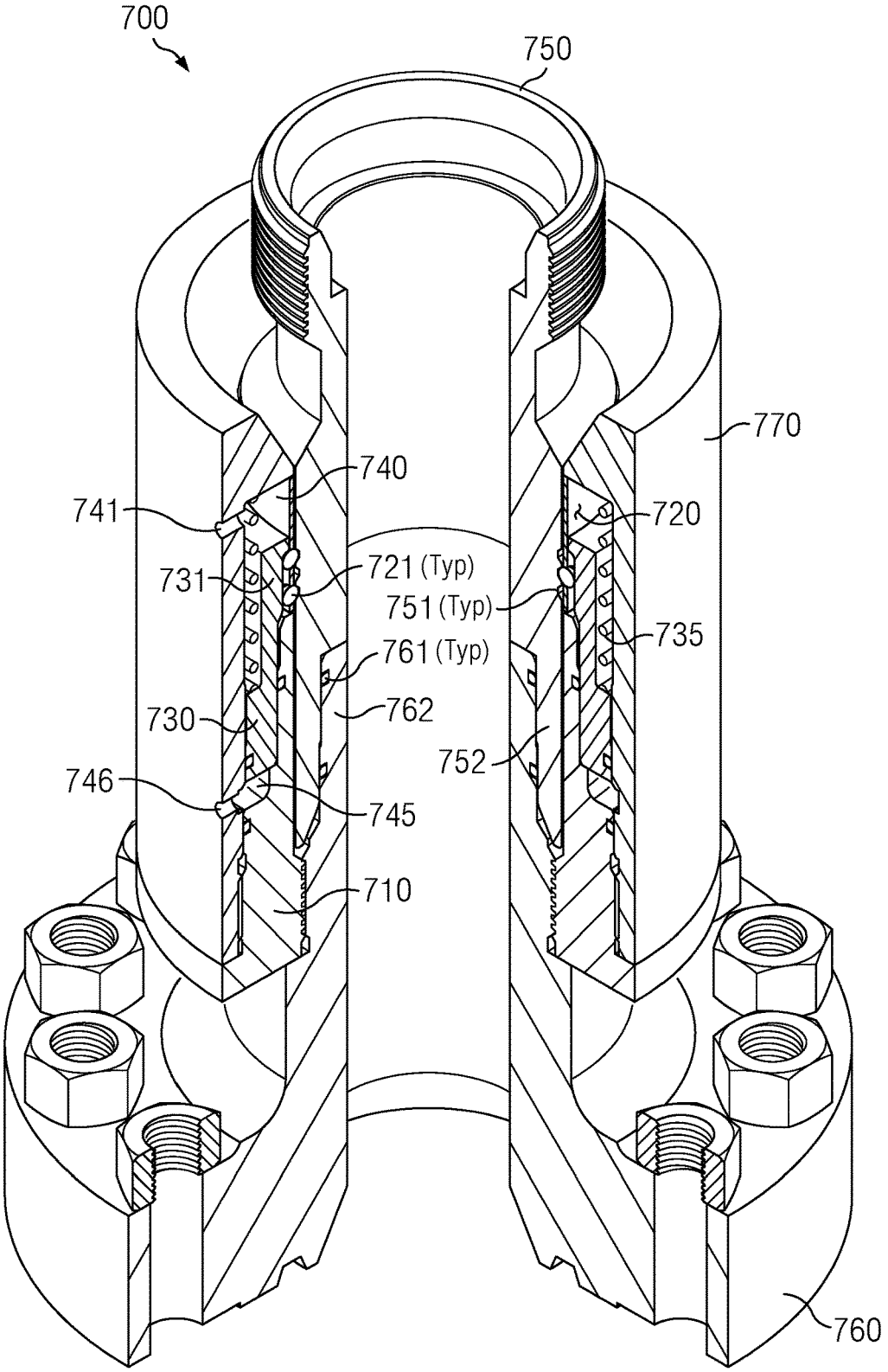
Figure 19A:
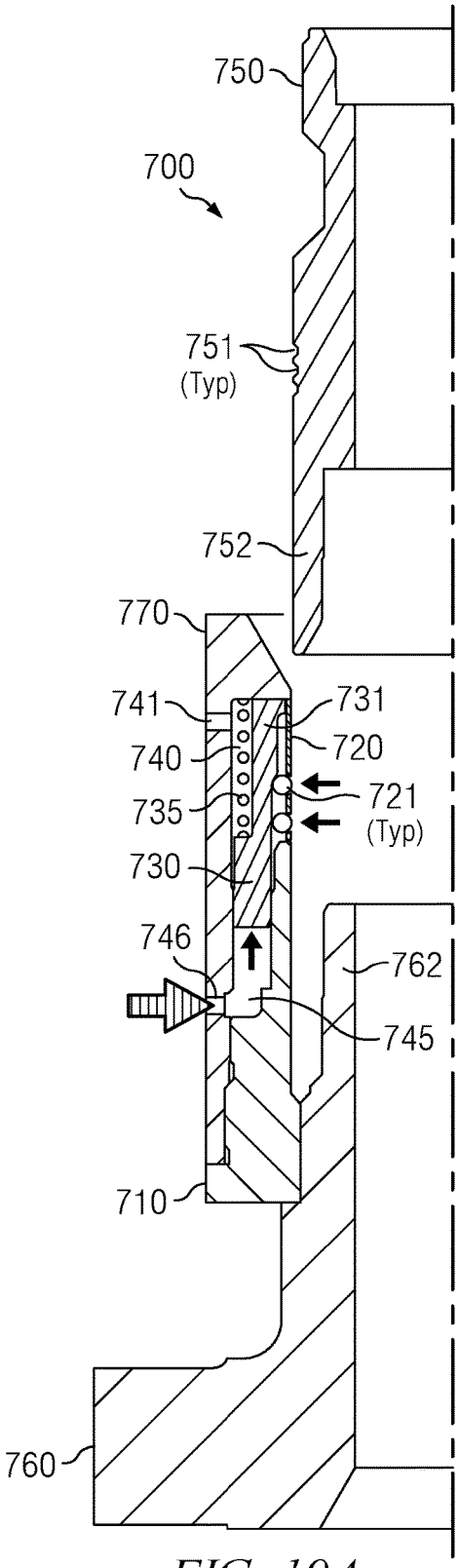
FIGS. 19A and 19B are partial section views in an unlocked position and a locked position respectively.
Figure 19B:
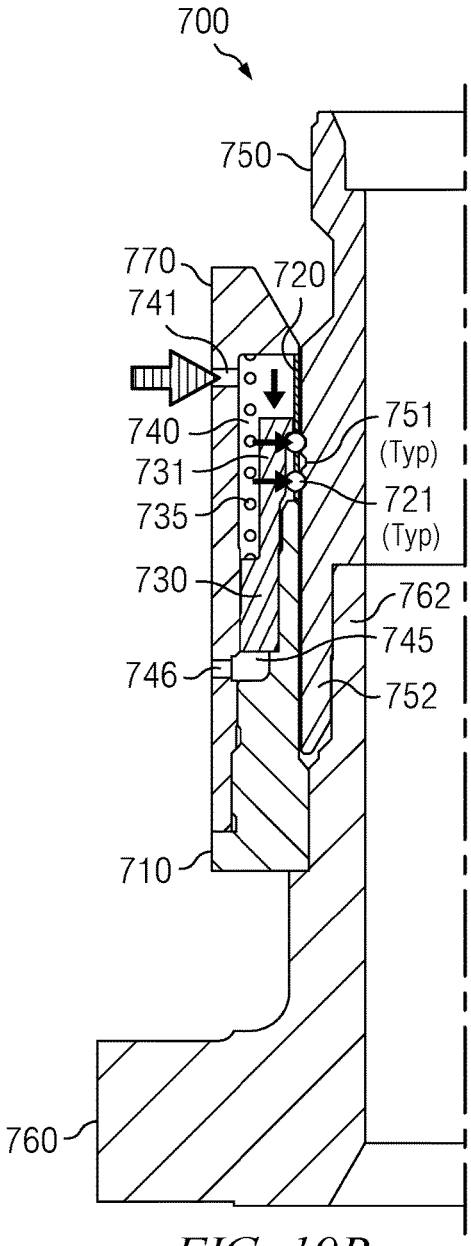
Figure 20:
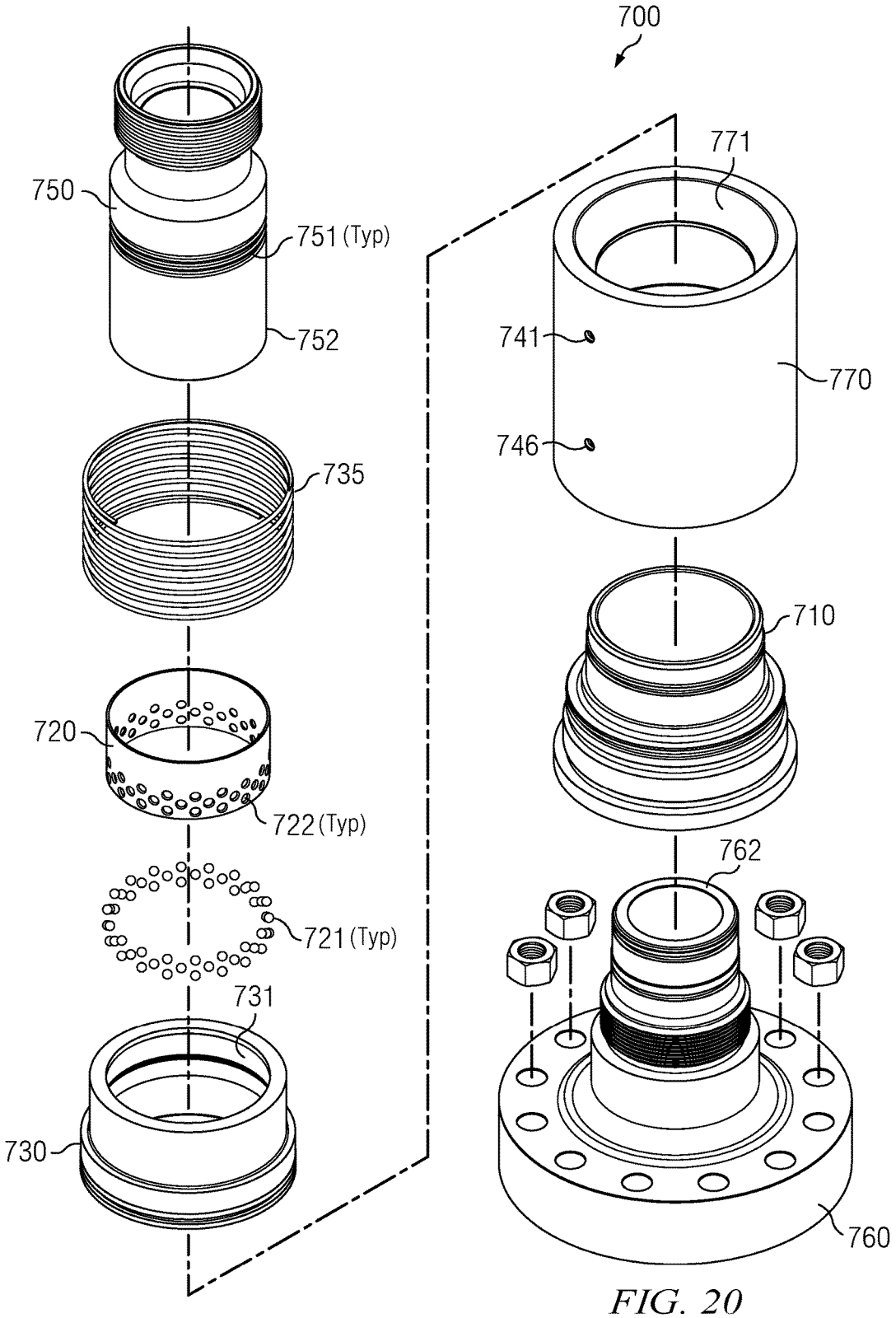

FIGS. 18 through 20 illustrate one embodiment of a spring-driven ball race seal design for providing a high pressure seal for wellhead pressure control fittings. FIGS. 21 through 28 illustrate two embodiments of a wedge seal design also for providing a high pressure seal for wellhead pressure control fittings. In FIGS. 21 through 24 a first embodiment of a wedge seal design is illustrated in which opposing sloped sides of wedges are driven in reciprocating motion directly by hydraulic fluid pressure. In the second embodiment, illustrated on FIGS. 25 through 28, the opposing sloped sides of the wedges are driven by hydraulically-actuated pistons.

Figure 1:
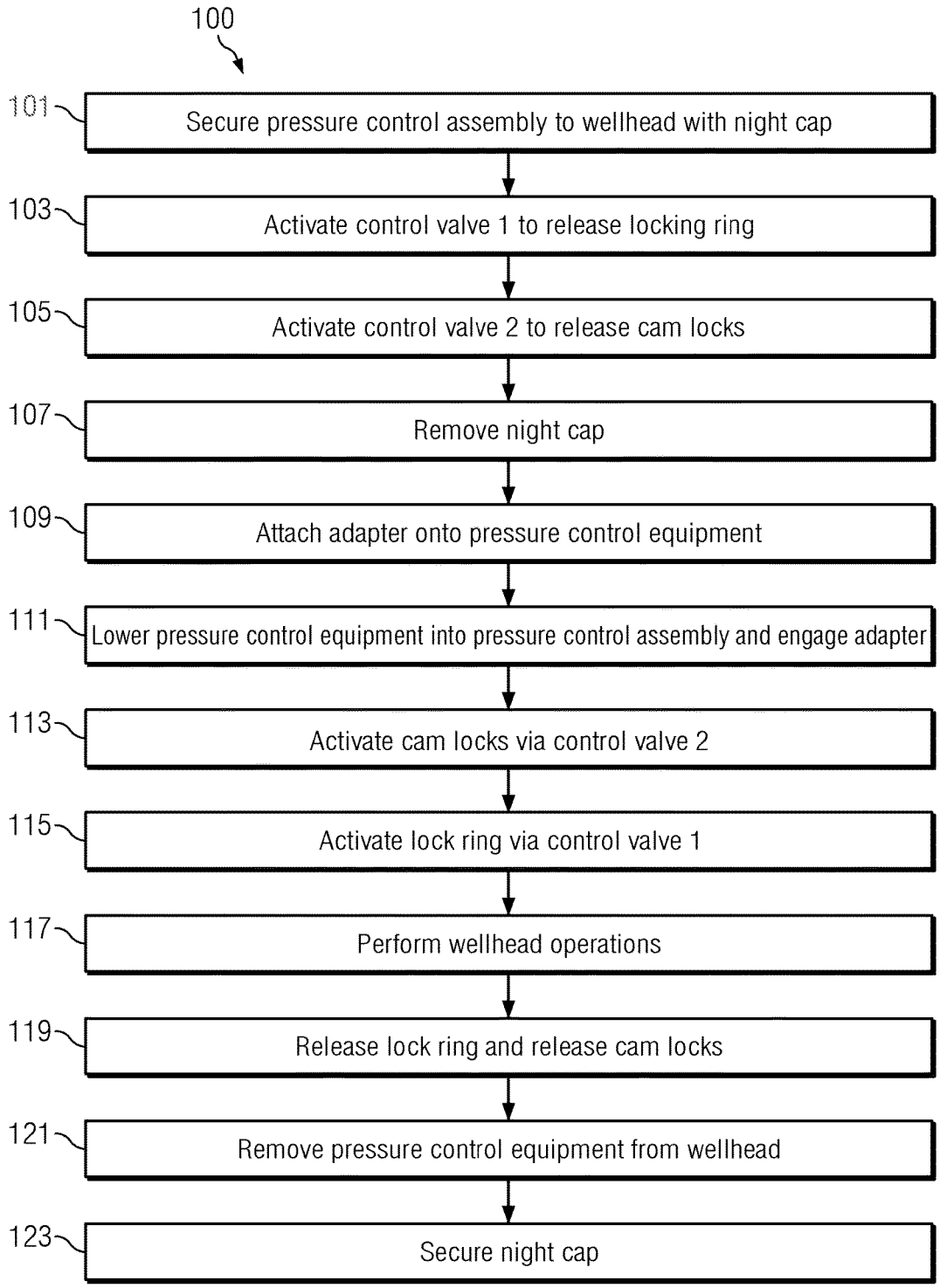
FIG. 1 is a flow chart describing in summary the engagement and disengagement of currently preferred embodiments of the disclosed cam lock pressure control apparatus.

FIG. 1 is a flow chart illustrating a method 100, describing in summary the steps to be followed in engaging the cam lock embodiments of the disclosed pressure control apparatus onto a wellhead prior to pressure control operations, and then disengaging the cam lock embodiments after the pressure control operations. It should be noted that the embodiment of method 100 illustrated on FIG. 1 makes use of a night cap option, as will be further described immediately below. In other embodiments of method 100 where the night cap option is not used (such embodiments not illustrated), it will be appreciated that the method steps in which the night cap would otherwise be used will either be simply not performed, or adapted in such a way not to use a night cap.

Referring now to FIG. 1, In blocks 101 through 107, the wellhead and the pressure control equipment ("PCE") to be in pressure communication with the wellhead are prepared for use of the cam lock embodiments of the disclosed pressure control apparatus. A pressure control assembly is secured to the top of the wellhead via conventional a flange bolt connection or similar (block 101). When the night cap option is provided, the pressure control assembly is secured to the well head in block 101 with the night cap already secured to the assembly via cam locks and a locking ring, as will be described below with reference to FIGS. 12 and 13. In order to remove the night cap (block 107), a first control valve is activated to release the locking ring (block 103), and then a second control valve is activated to release the cam locks (block 105). The details of locking ring/cam lock release and engagement will be described below. It will be understood that activation of first and second control valves is advantageously done remotely. As will be also seen in further Figures, the pressure control assembly presents a receptacle for receiving a customized adapter on the PCE side. The adapter is secured to the PCE in block 109. The PCE is then lowered onto/into the pressure control assembly such that the adapter engages within its receptacle (block 111).

With further reference to FIG. 1, the cam lock sealing mechanism may then be remotely engaged. First, by remote hydraulic actuation, and as illustrated in block 113, the second control valve opens and causes cam lock pistons to extend, causing rotation of cam locks. Rotation of the cam locks moves them into an engaged position whereby they forcibly bear down on a shoulder on the adapter (as received into its receptacle). Rotation of the cam locks thus has the effect of pressure sealing the connection between the wellhead and the PCE. Then, again by remote hydraulic actuation, the first control valve opens and causes locking ring pistons to retract, causing a locking ring to move into position over the cam locks and retain them in the engaged position (block 115). The locking ring acts primarily a safety device to prevent the cam locks from unintentionally becoming disengaged in the event of, for example, a loss of hydraulic pressure.

Figure 12:
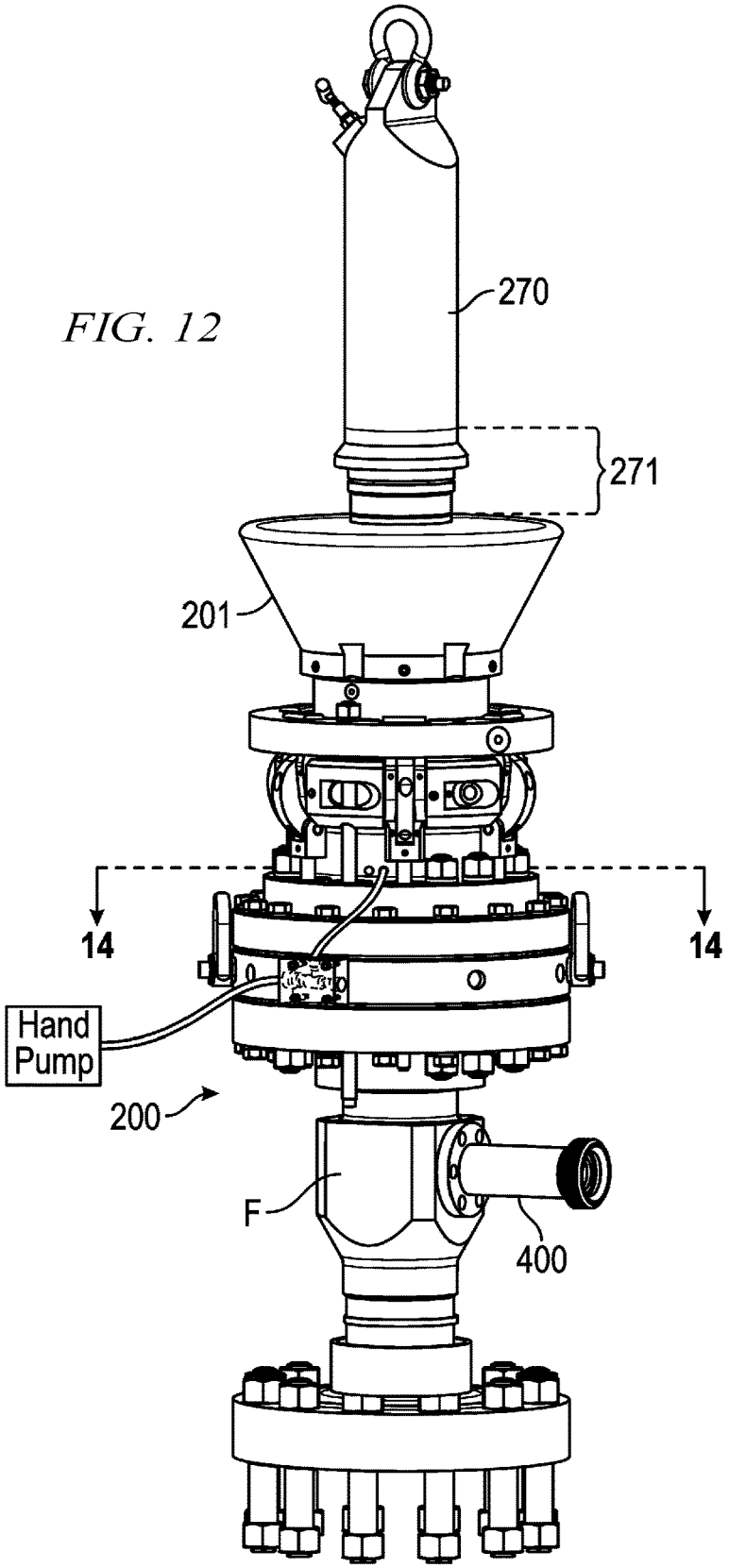
Figure 13:
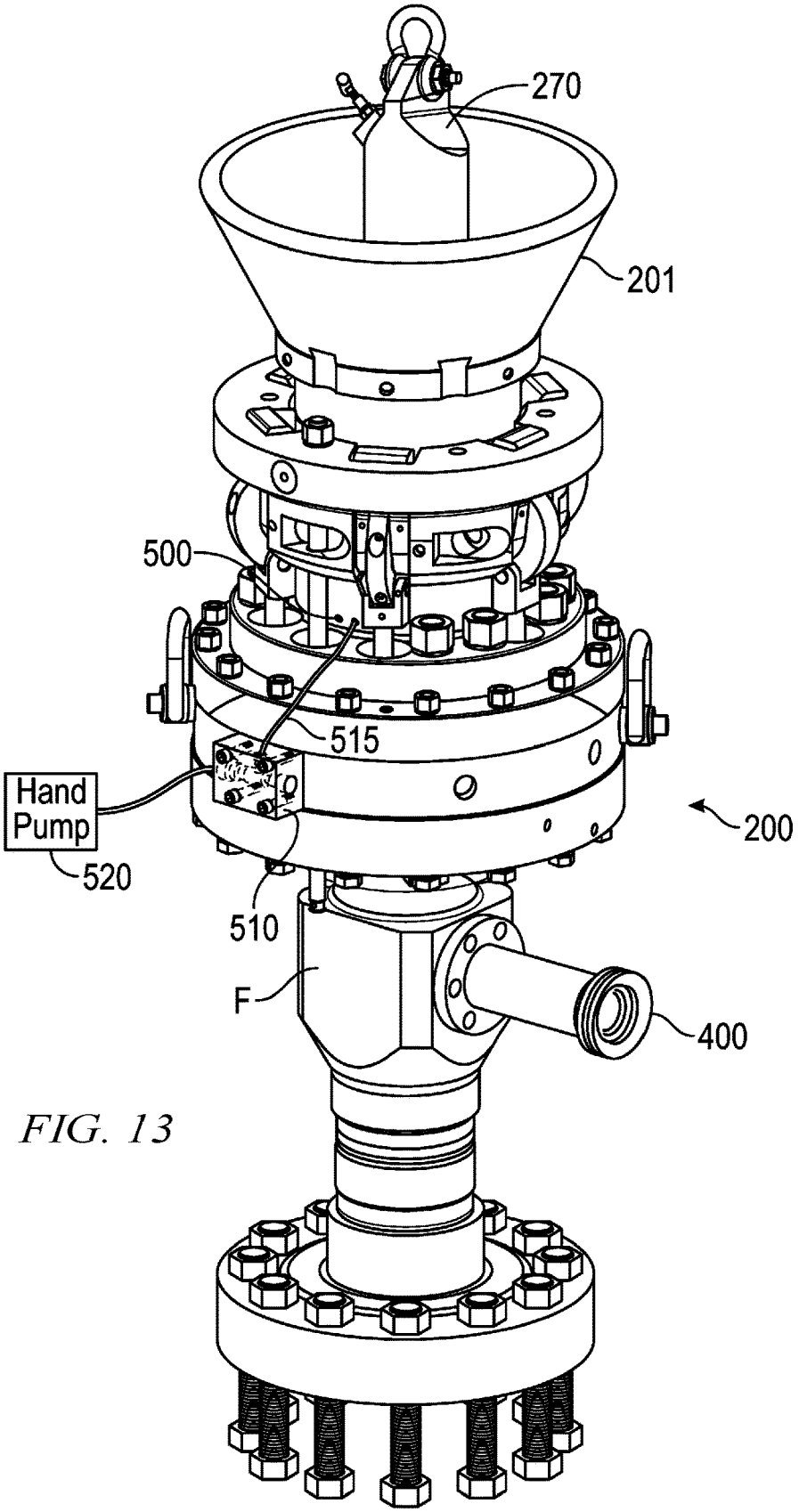

As further shown on FIG. 1, the PCE is now pressure sealed to the wellhead via the disclosed pressure control apparatus and wellhead operations may be conducted (block 117). When wellhead operations are complete, the apparatus may be disengaged remotely by essentially reversing the previous steps (block 119). First, the locking ring pistons are extended causing the locking ring move away from the cam locks, thereby freeing the cam locks to rotate again. Then the cam lock pistons are retracted, causing the cam locks to rotate in the opposite direction so as to disengage from the shoulder on the adapter (fitted to the PCE). The PCE may then be removed from the wellhead (block 121) by withdrawing the adapter (fitted to the PCE) from its receptacle. When the night cap option is provided, the night cap may then be secured again to the pressure control assembly (block 123). Securement of the night cap is essentially the reverse of the steps illustrated in blocks 103 and 105, and a repeat of the steps illustrated on blocks and 113 and 115, except on the night cap instead of adapter fitted to the PCE. Refer below to FIGS. 12 and 13 and associated disclosure for further details.

Figure 2:
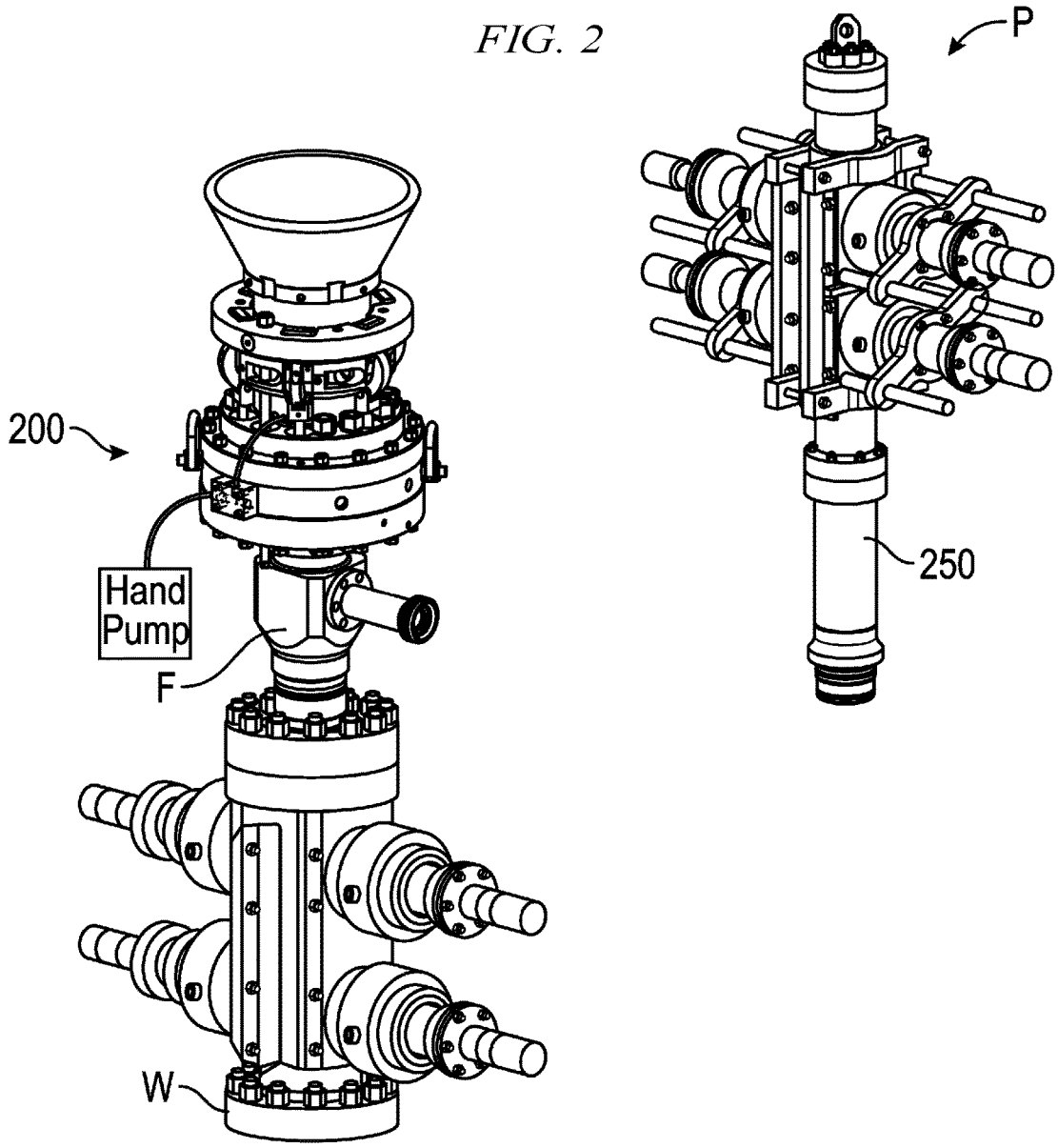

FIGS. 2 through 11 are a freeze-frame series of illustrations depicting a first embodiment of method 100 on FIG. 1 in more detail. In FIG. 2, pressure control equipment ("PCE") is labeled generally as P, and wellhead is labeled generally as W. Pressure control assembly 200 is secured to wellhead W via a conventional bolted flange, although this disclosure is not limited in this regard. The wellhead end of pressure control assembly 200 advantageously provides a customized fitting F to connect to wellhead W. Adapter 250 is secured to PCE P via conventional threading, although again this disclosure is not limited to a threaded connection between PCE P and adapter 250.

Figure 3:
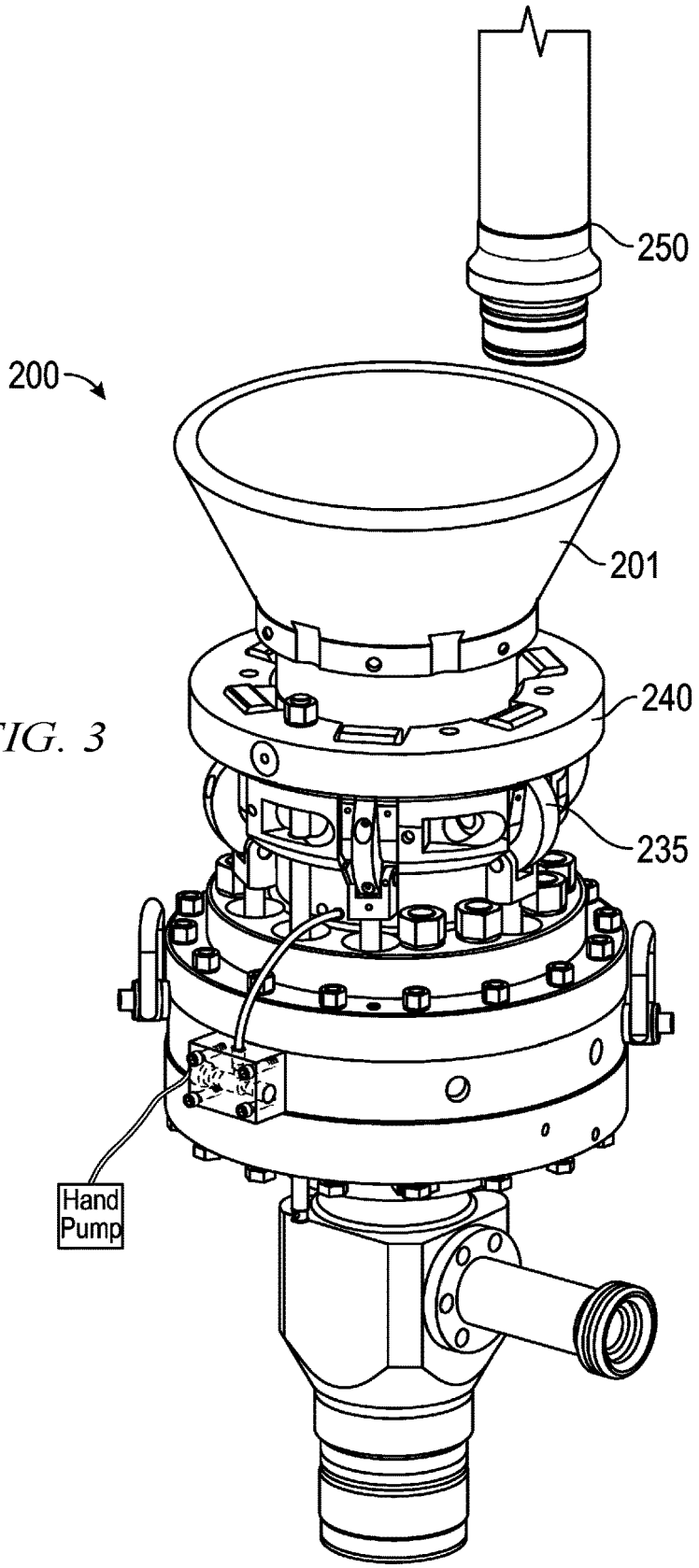

In FIG. 3, PCE has been lifted and moved over pressure control assembly 200 using, for example, a conventional crane (not shown). Entry of adapter 250 into pressure control assembly 200 is facilitate by tulip 201, a conically-shaped piece. For reference, locking ring 240 and link arms 235 are also visible on FIG. 3.

Figure 4:
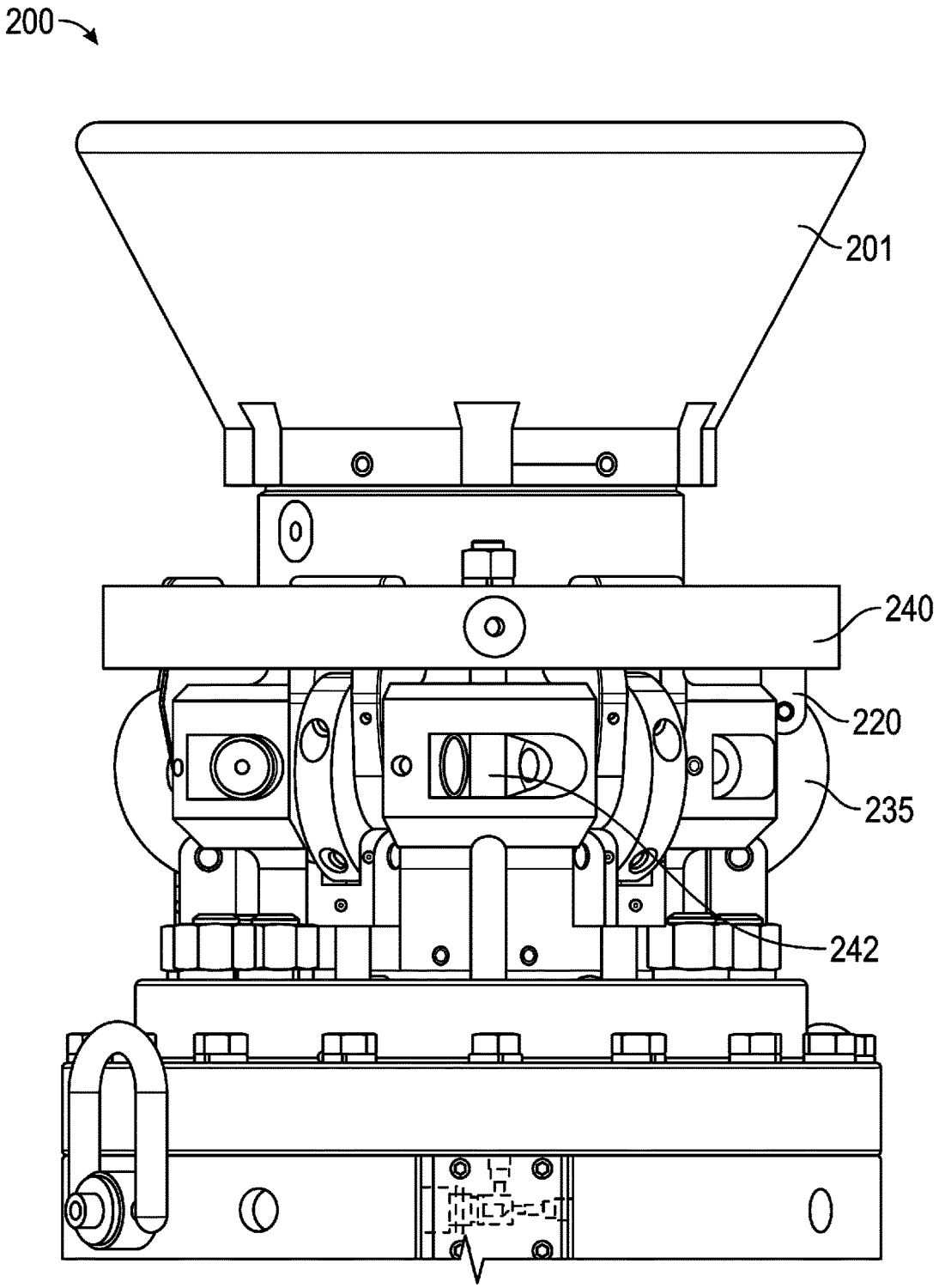

FIG. 4 is an elevation view of a top portion of pressure control assembly 200 in more detail. Tulip 201, locking ring 240, link arms 235 and cam locks 220 are visible. It will be appreciated that on FIG. 4, locking ring 240 and cam locks 220 are in their disengaged position. One of locking ring pistons 242 is also visible on FIG. 4 in a partially extended state. Locking ring pistons 242 are preferably conventional hydraulic pistons, and will be illustrated and described in more detail further on.

Figure 5:
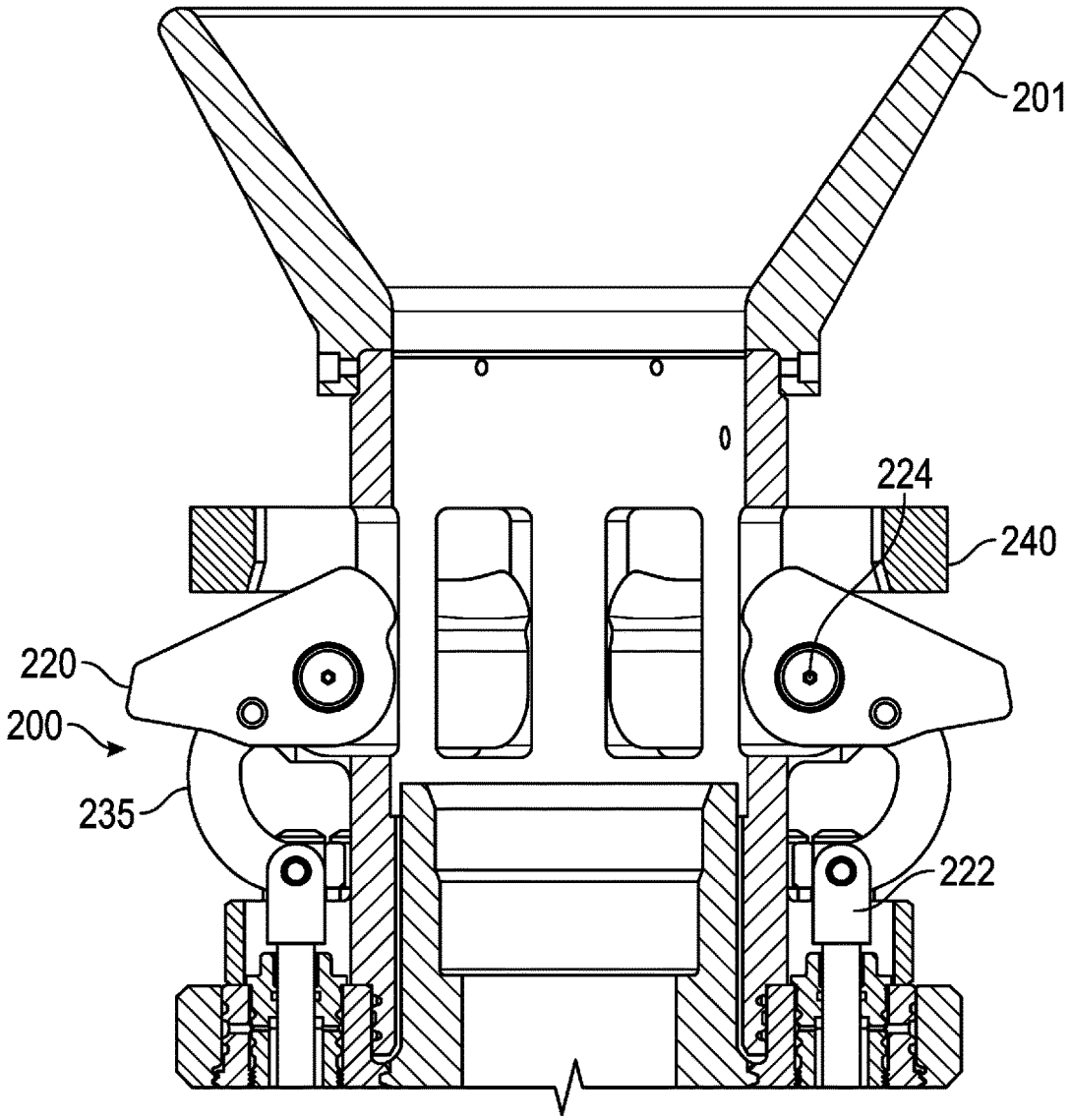

FIG. 5 is the elevation of FIG. 4, except in partial cutaway view to illustrate more clearly the component parts of pressure control assembly 200. Tulip 201, locking ring 240, cam locks 220, link arms 235 and cam lock pistons 222 are all visible on FIG. 5. It will also be appreciated that cam lock pistons 222, link arms 235 and cam locks 220 together form a pinned linkage in which extension and retraction of cam lock pistons 222 will cause cam locks 220 to rotate about cam lock pins 224. Cam lock pistons 222 are preferably conventional hydraulic pistons.

Figure 6:
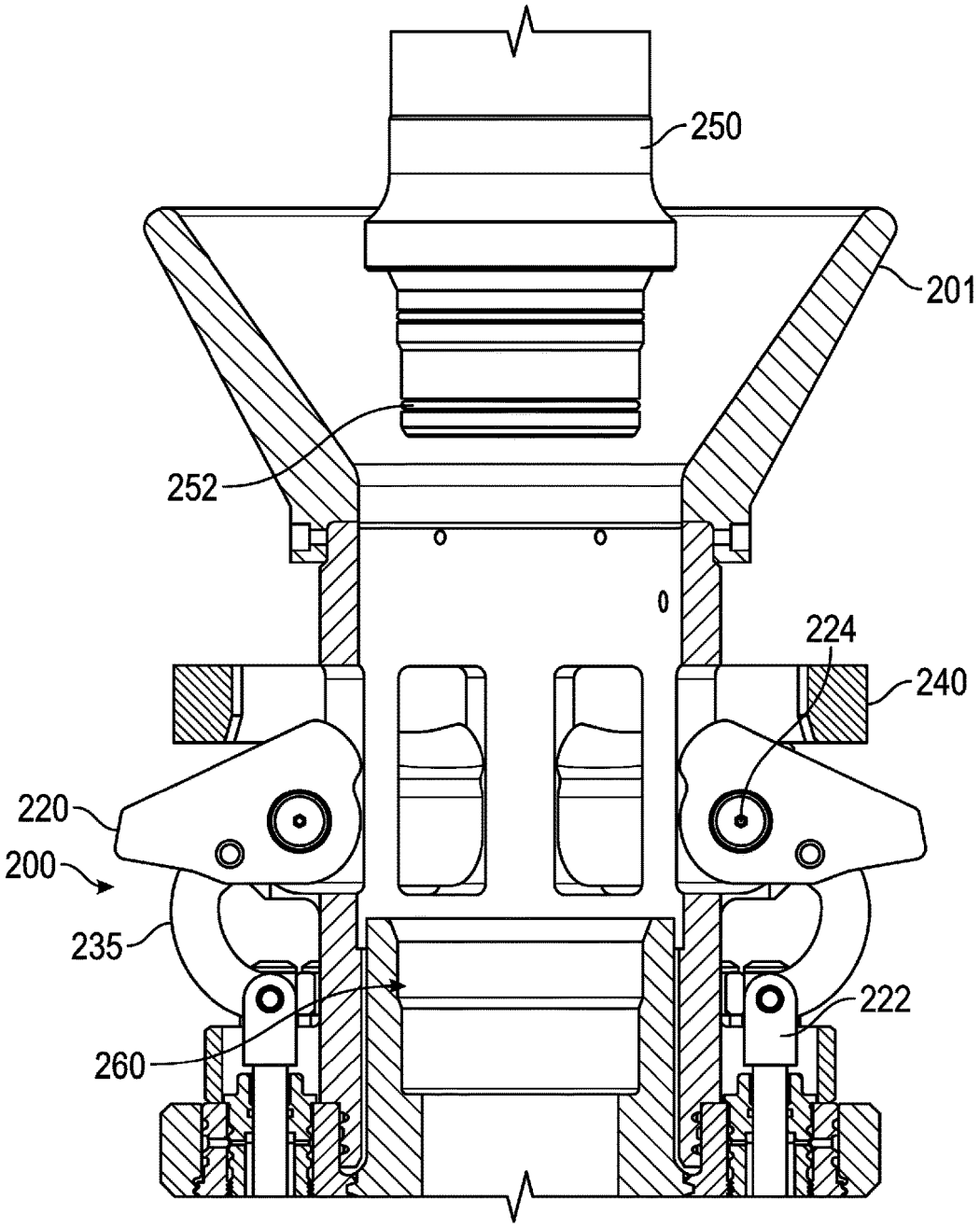

FIG. 6 shows adapter 250 (attached to PCE) entering pressure control assembly 200 with the assistance of tulip 201. Receptacle 260 for adapter 250 is also illustrated, waiting to receive adapter 250. Conventional o-rings 252 are visible on adapter 250.

Figure 7:
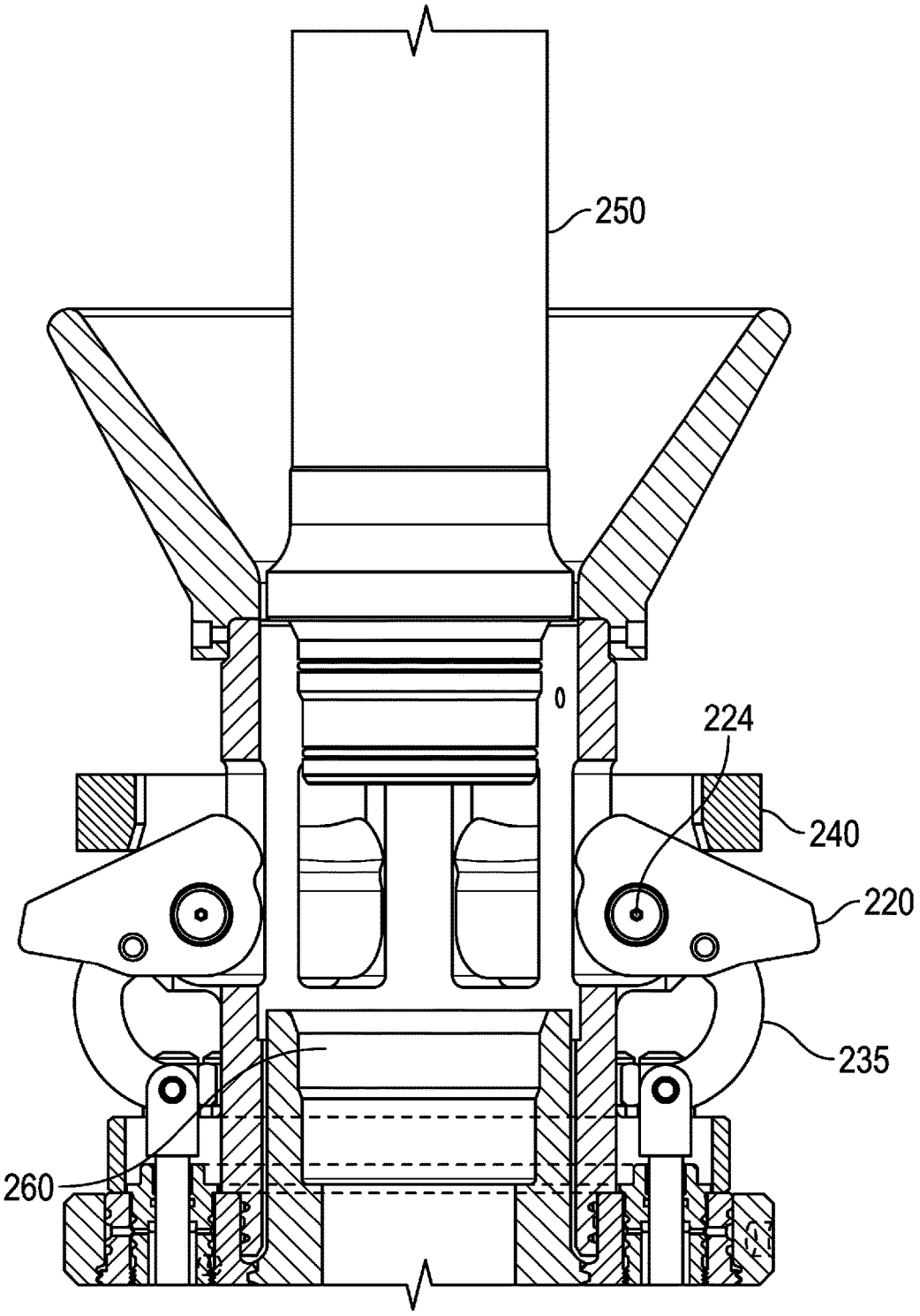
Figure 8:
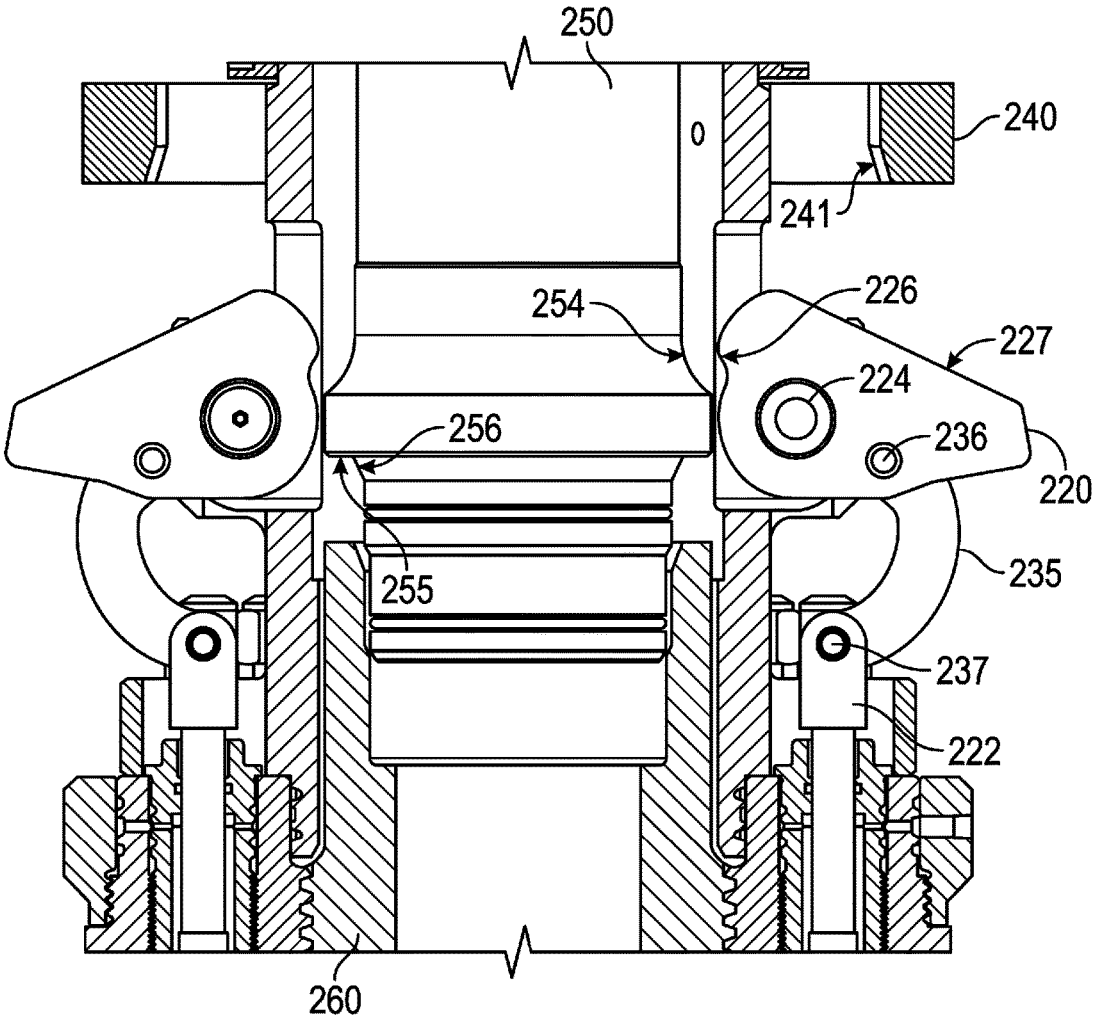
Figure 9:
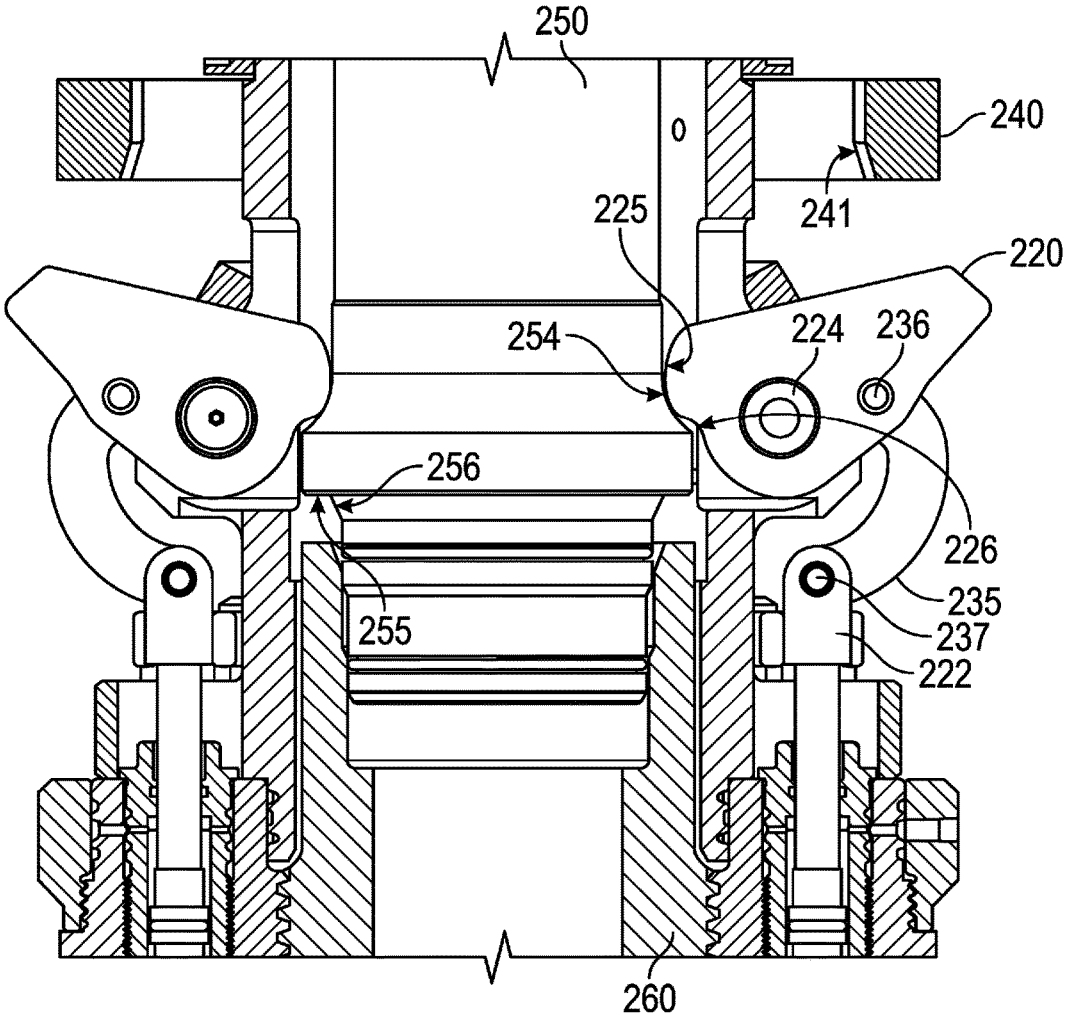
Figure 10:
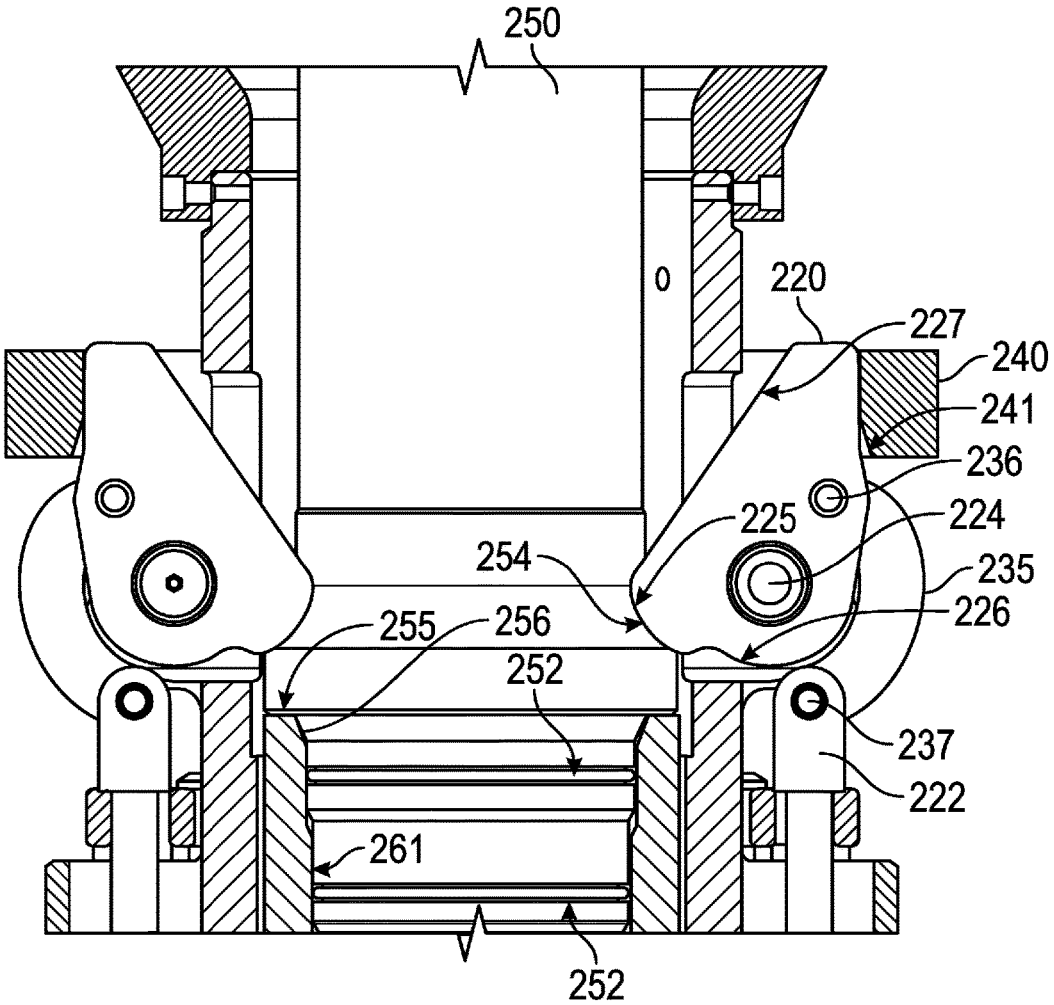

FIG. 7 is the view of FIG. 6 except that adapter 250 is moving closer to its seat in receptacle 260. FIGS. 8 through 10 are magnified freeze-frame views as adapter 250 engages its seat in receptacle 260. As will be described in greater detail further on, FIGS. 8 and 9 depict noteworthy features regarding the seating of adapter 250 in receptacle 260. First, adapter 250 is engineered to fit in receptacle 260 so as to provide a high pressure seal when the connection is in compression. Second, shoulder 254 on adapter 250 presents a curvature that is shaped and located to match a corresponding cam curvature 225 (refer FIG. 9) on cam locks 220. As cam locks 220 rotate responsive to extension of cam lock pistons 222, cam curvatures 225 on cam locks 220 engage shoulder 254 and compress adapter 250 into receptacle 260.

On FIGS. 8 and 9, locking ring 240 has been moved away from cam locks 220 via full extension of locking ring pistons 242 (pistons 242 are not shown on FIGS. 8 and 9, see FIG. 4 instead). FIGS. 8 and 9 also illustrate the cam lock linkage in more detail, discussed above with reference to earlier Figures. With particular reference to FIG. 9, it will be seen that cam locks 220 are disposed to rotate about cam lock pins 224. Cam locks 220 each present cam curvatures 225. Cam locks 220 are in pinned linkage connection to cam lock pistons 222 via link arms 235, and first and second linkage pins 236 and 237.

Referring now to FIG. 8, cam locks 220 provide cam lock notches 226 in order to assist capture of shoulder 254 on adapter 250. With reference now to FIGS. 9 and 10, it will be seen that once cam lock notches 226 have engaged shoulder 254, further rotation of cam locks 220 around cam lock pins 224 encourages snug engagement of cam curvatures 225 on shoulder 254 in order to provide a high pressure seal. The relative dimensions, geometries, locations in space, and paths of travel of cam lock pistons 222, first and second linkage pins 236 and 237, link arms 235, cam locks 220, cam lock pins 224, cam lock notches 226 and cam curvatures 225 are all selected, designed and engineered to cooperate with corresponding selections of dimensions and geometries on shoulder 254, seat surface 255 and slope surface 256 on adapter 250 interfacing with receptacle 260, all to bring about a high-pressure seal via compression of adapter 250 into receptacle 260. In preferred embodiments, there is about a 5-thousandths of an inch (0.005") clearance between the exterior cylindrical surface of adapter 250 and the interior cylindrical surface of receptacle 260. This clearance allows for a pressure-controlling seal with o-rings 252. Further, as will be seen on FIGS. 8 through 10, adapter 250 provides machined surfaces on seat surface 255 and slope surface 256. Receptacle 260 also provides corresponding machined surfaces shaped to match seat surface 255 and slope surface 256. Compression of adapter 250 into receptacle 260 thus enables a machined surface metal-to-metal seal at seat surface 255 and slope surface 256. This metal-to-metal seal is engineered to contain high pressures—up to about 15,000 psi MAWP in preferred embodiments. However, with reference to the cooperating abutment surfaces at the interface of adapter 250 and receptacle 260, it will appreciated that the scope of this disclosure is not limited to embodiments providing a machined surface metal-to-metal seal at seat surface 255 and slope surface 256, and that other embodiments may provide other suitable sealing arrangements.

With continuing reference to FIGS. 8 and 9, and moving on to FIG. 10, the operation of cam locks 220 to compress adapter 250 into receptacle 260 is illustrated, thereby enabling the high pressure seal discussed above. On FIG. 8, adapter 250 is entering receptacle 260. Cam lock pistons 222 are fully retracted, and cam curvatures 225 are disengaged. On FIG. 9, extension of cam lock pistons 222 has begun, causing rotation of cam locks 220 about cam lock pins 224 such that cam lock notches 226 have assisted capture of shoulder 254 on adapter 250. On FIG. 10, cam lock pistons 222 are fully extended. The pinned linkage of cam locks 220 to cam lock piston 222 (via link arm 235 and first and second linkage pins 236 and 237) will be seen to have translated the extension of cam lock pistons 222 into rotation of cam locks 220 about cam lock pins 224. Rotation of cam locks 220 about cam lock pins 224 brings cam curvatures 225 to bear on shoulder 254 on adapter 250. Cooperating abutment surfaces at the contact interface of adapter 250 and receptacle 260 are compressed together to form a high pressure seal.

Referring now to FIG. 10, it will be seen that the linkage between cam locks 220, link arms 235 and cam lock pistons 222 is configured so that when cam locks 220 are fully engaged on shoulder 254, locking ring 240 may be lowered to engage cam locks 220. Engagement of cam locks 220 by locking ring 240 is via full retraction of locking ring pistons 242 (pistons 242 are not shown on FIG. 10, see FIG. 4 instead). Cam locks 220 also provide cam lock tapers 227 in order to assist capture of cam locks 220 by locking ring 240. With continuing reference to FIG. 10, it will be seen that as locking ring 240 is lowered to retain and secure cam locks 220 in an engaged position on shoulder 254, corresponding locking ring tapers 241 on locking ring 240 cooperate with cam lock tapers 227 to assist engagement of locking ring 240 on cam locks 220. In preferred embodiments, locking ring 240 may be shaped and sized to provide an interference fit between itself and cam locks 220 to retain and secure them once fully engaged on cam locks 220.

The action of locking ring 240 to secure cam locks 220 is primarily for safety purposes, to prevent cam locks 220 from becoming disengaged from shoulder 254 on adapter 250 in the event of a loss in hydraulic pressure (or otherwise) potentially compromising the high-pressure seal between adapter 250 and receptacle 260. However, it will be appreciated from the immediately preceding paragraphs that the interference fit between locking ring 240 and cam locks 220 also enables, as a secondary effect, an additional "squeezing" force on cam locks 220 when fully engaged on shoulder 254 on adapter 250.

It will be appreciated that in preferred embodiments, extension and retraction of cam lock pistons 222 and locking ring pistons 242 may be done by remote hydraulic operation, fulfilling one of the technical advantages of the cam lock embodiments of the disclosed pressure control apparatus as discussed earlier in this disclosure. It will be further appreciated that the "engineered motion and fit" of the cooperating parts as illustrated on FIGS. 8 through 10 are not limited any particular can lock embodiment that might generate a high-pressure seal for a certain size or model of the disclosed pressure control apparatus. It will be appreciated that, consistent with the scope of this disclosure, many such "engineered motion and fit" arrangements may be selected and designed for different sizes or models.

Figure 11:
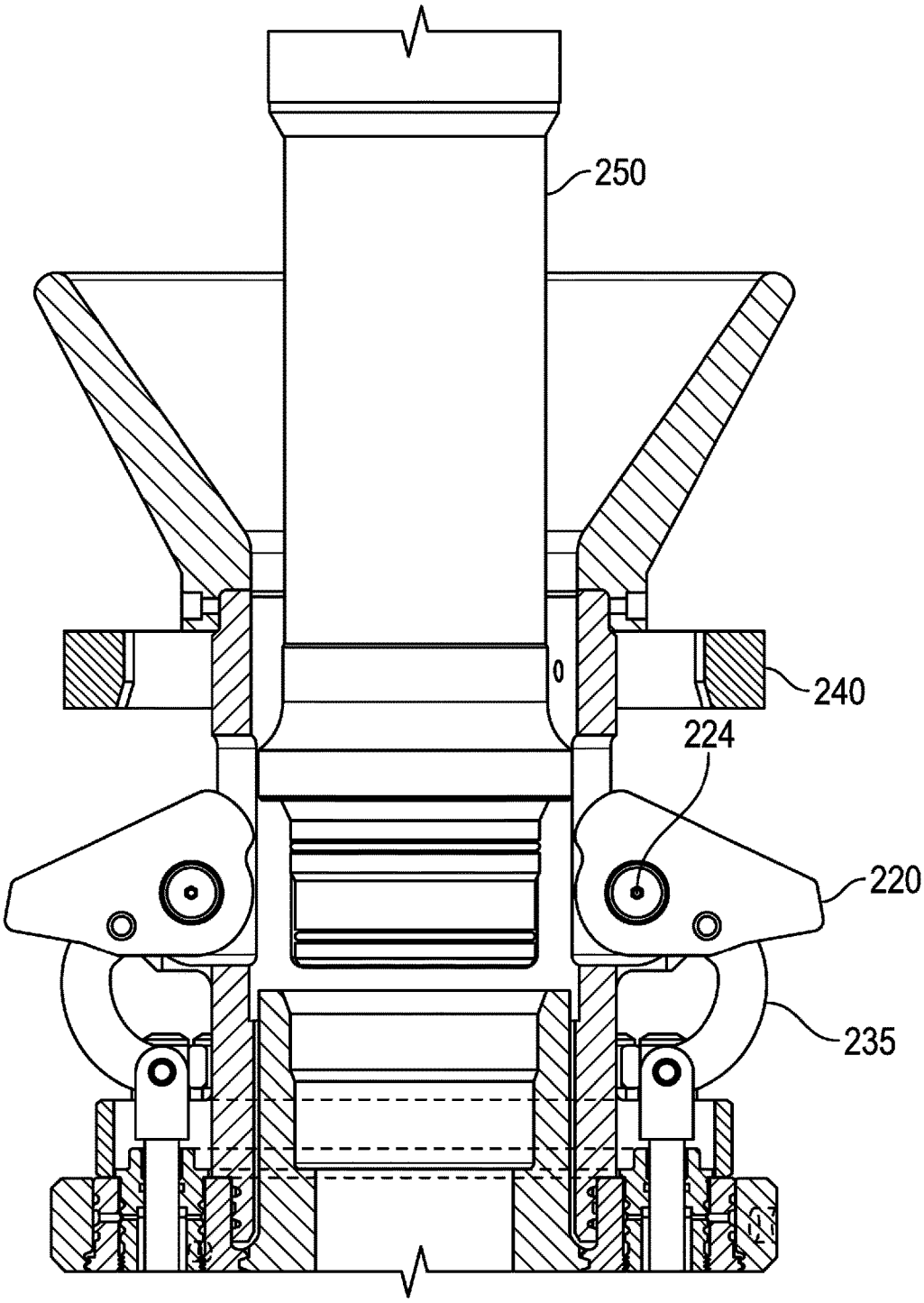

FIG. 11 illustrates disengagement of the cam lock embodiments of the disclosed pressure control apparatus. The mechanism is essentially the reverse of engagement, described above with reference to FIGS. 6 through 10. Extension of locking ring pistons 242 (refer FIG. 4) disengages locking ring 240 from cam locks 220, enabling release of cam locks 220. Retraction of cam lock pistons 222 causes cam locks 220 to rotate around cam lock pins 224 and release cam curvatures 225 from shoulder 254 on adapter 250. Adapter 250 may then be withdrawn from receptacle 260. It will be appreciated from FIG. 11 that when cam locks 220 are in a disengaged state, locking ring 240 advantageously does not make contact with cam locks 220. This separation between locking ring 240 and disengaged cam locks 220/link arms 235 applies whether locking ring pistons 242 (refer FIG. 4) are in an extended or retracted state.

Referring now to commonly invented, commonly-assigned U.S. provisional patent application Ser. No. 62/263,889, incorporated herein by reference, FIGS. 2 through 13 in 62/263,889 are a freeze-frame series of illustrations depicting a second embodiment of method 100 on FIG. 1 in more detail. The second embodiment of method 100, as illustrated on FIGS. 2 through 13 of 62/263,889, is very similar to the embodiment depicted on FIGS. 2-11 in this disclosure, except that, primarily, (1) cam locks 220 in 62/263,889 are shaped more smoothly and do not provide a notch corresponding to cam lock notches 226 in this disclosure, (2) locking ring 240 in 62/263,889 is shaped and configured to be received onto link arms 235 in 62/263,889 rather than directly onto cam locks 220 in this disclosure, and (3) the geometry of the linkage (and path of travel of the linked components) for cam locks 220, link arms 235 and cam lock pistons 222 in 62/263,889 is different than in this disclosure.

While both the embodiment disclosed in FIGS. 2 through 13 in 62/263,889 (and associated text) and the embodiment described with reference to FIGS. 2 through 11 in this disclosure are serviceable, the embodiment described in this disclosure is currently preferred. Comparison of the performance of prototypes of each embodiment has shown that the embodiment described in this disclosure demonstrated improved pressure retention in the seal created via compression of adapter 250 into receptacle 260. Prototypes of each embodiment on 5.125" internal diameter bores were pressure tested. In the embodiment disclosed in FIGS. 2 through 13 of 62/263,889 (and associated text), design was for about a 5,000 psi MAWP using a 7,500 psi test pressure. The ultimate destruction load was in fact just under 15,000 psi. In the embodiment described in this disclosure with reference to FIGS. 2 through 11 herein, design was for about 10,000 psi MAWP with a 15,000 psi test load. Testing towards to ultimate destruction load was up to 17,500 psi without failure.

As has been described previously, embodiments of the disclosed pressure control apparatus are available with a separate night cap option. Blocks 101-107 and 123 in method 100 on FIG. 1 make reference to the night cap (when the night cap option is used), and are described in general in the disclosure above associated with FIG. 1. FIGS. 12 and 13 illustrate release and engagement of the night cap (as described with reference to FIG. 1) in more detail. FIGS. 12 and 13 illustrate night cap 270 entering tulip 201 and preparing to be engaged on pressure control assembly 200. FIG. 12 illustrates engagement portion 271 on night cap 270. Engagement portion 271 has functionally identical structure to that seen on adapter 250 on, for example, FIG. 8. FIG. 8 illustrates shoulder 254, seat surface 255 and slope surface 256 on adapter 250 interfacing with receptacle 260 on pressure control assembly 200 to provide a high pressure seal when cam locks 220 and locking ring 240 are engaged. Likewise, engagement portion 271 on FIG. 12 provides functionally identical features on night cap 270 so that night cap 270 can engage with receptacle 260 in the same way as adapter 250 engages with receptacle 260, via formation of a high pressure seal through engagement of cam locks 220 and locking ring 240. FIG. 13 depicts night cap secured into pressure control assembly 200 in the manner just described.

It will also be seen on FIGS. 12 and 13 that night cap 270 advantageously provides a shackle or other conventional lifting attachment. This feature enables lifting apparatus (such as a crane) to attach to night cap 270 while secured in pressure control assembly 200, providing a convenient hitch point and lifting connection for the entire pressure control apparatus. This feature thus facilitates, for example, lowering/raising of the entire apparatus during connection or disconnection from the well head, or between the wellhead and other transportation.

FIGS. 12 and 13 further depict vent line 400 provided in fitting F, as previously described above with reference to FIG. 2. In currently preferred embodiments, vent line 400 provides no internal mechanisms, and acts as a simple, conventional relief line with suitable connection fittings at either end (e.g. bolted flange, o-ring or threaded connection). Vent line 400 allows fluid under pressure in pressure control assembly 200 above wellhead W to be relieved and drained at such times as, for example, during removal of pressure control assembly 200 from wellhead W.

Figure 14:
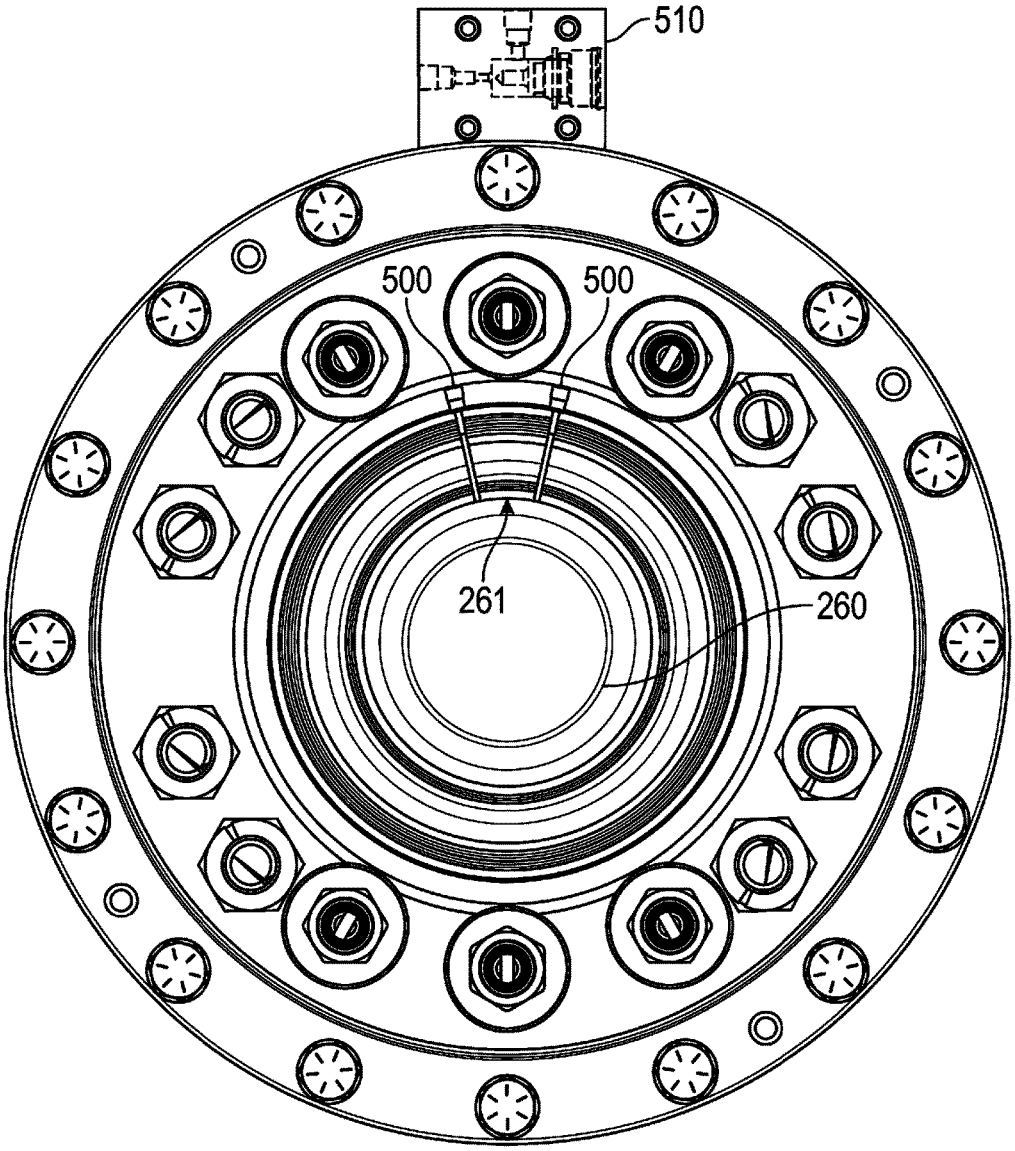
Figure 15:
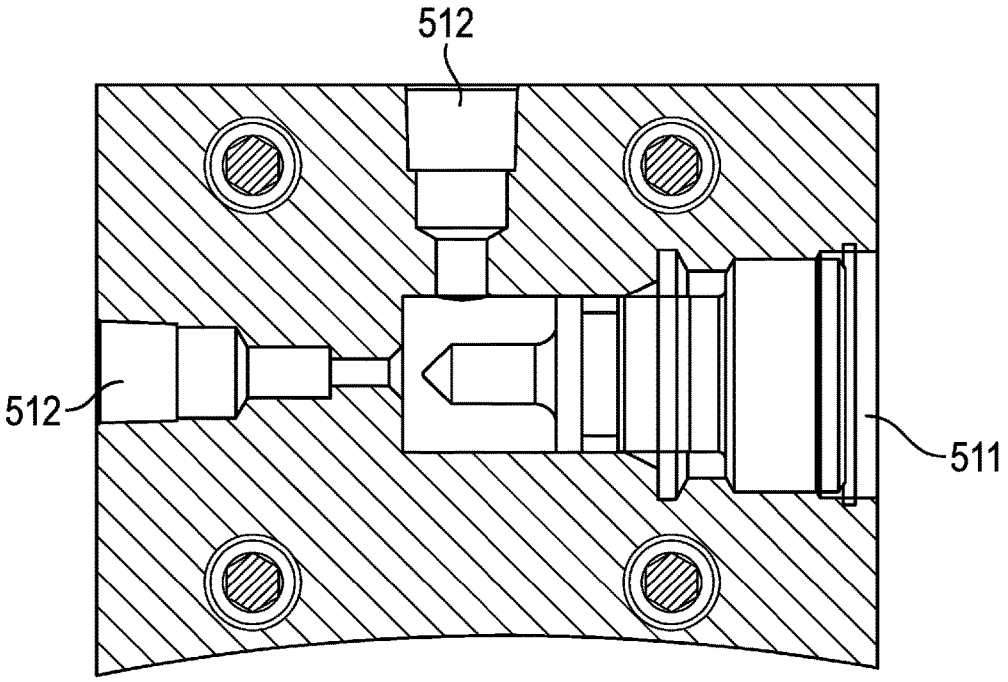

FIGS. 13 through 15 depict quick test ports 500 and associated manifold box 510 provided on pressure control assembly 200. FIG. 13 shows quick test ports 500 and manifold box 510 as seen from the outside of pressure control assembly 200. A conventional high pressure hydraulic hose 515 connects manifold box 510 to one of the quick test ports 500. As shown on FIG. 13, a conventional hydraulic hand pump 520, preferably operated remotely, injects fluid into manifold box 510 under pressure, and then, via hose 515, through to one of the quick test ports 500. It will be appreciated that although FIG. 13 illustrates a currently preferred embodiment in which two quick test ports 500 are provided. The scope of this disclosure is not limited in this regard, and any number may be provided. However, only one will be in operation at any time. Quick test ports 500 that are not in operation e sealed with threaded plugs for future use. The purpose of providing redundant quick test ports 500 is in case one or more become damaged during service, and have to be permanently sealed. In presently preferred embodiments, quick test ports 500 are preferably 1/16" in diameter, although the scope of this disclosure is not limited in this regard.

FIG. 14 is a section as shown on FIG. 12, cutting through pressure control assembly 200 at the centerline elevation of quick test ports 500 (refer FIG. 13). FIG. 14 depicts quick test ports 500 providing fluid passageways from the outside of pressure control assembly 200 through to the interior of receptacle 260 along interior portion 261. Quick test ports 500 further preferably provide fluid passageways to the interior of receptacle 260 at elevations between o-rings 252 when, as shown on FIG. 10, adapter 250 is fully compressed into receptacle 260 by cam locks 220 and the desired high pressure connection between adapter 250 and receptacle 260 is formed.

With continuing reference to FIG. 10, it will be seen that interior wall portion 261 of receptacle 260 engages adapter 250 between o-rings 252 when adapter 250 is received operationally into receptacle 260. It will be further appreciated that when high pressure fluid is introduced from beneath receptacle 260, the seals created by o-rings 252 will restrict or impede the ability of fluid to enter the engagement of adapter 250 with receptacle 260 along interior wall portion 261.

Returning now to FIGS. 13 and 14, it will be seen that quick test port 500 enables fluid, pumped by hand pump 520 and delivered via manifold box 510 and hose 515, to be introduced into the engagement of adapter 250 with receptacle 260 along interior wall portion 261, thereby equalizing the pressure between o-rings 252 when high pressure fluid is introduced from beneath receptacle 260.

Conversely, it will be appreciated that upon removal of adapter 250 from receptacle 260, the seals created by o-rings 252 will restrict or impede the ability of fluid to depressurize in the engagement of adapter 250 with receptacle 260 along interior wall portion 261. Quick test port 500 enables fluid trapped at pressure between o-rings 252 to be relieved. In other applications, fluid delivered by hand pump 520 through quick test port 500 enables the integrity of the seals provided by o-rings 252 to be checked prior to introducing high pressure fluid into the connection between adapter 250 and receptacle 260.

FIG. 15 is a horizontal section through manifold box 510 illustrating more clearly the details shown in broken lines on, for example, FIGS. 13 and 14. Broadly, it will be appreciated that manifold 510 acts as a needle valve in the fluid line between hand pump 520 and quick test port 500. This needle valve functionality acts as an added failsafe in the hydraulic line, so that pressure may be shut down in the event of an unintended leak during operations. Referring to FIG. 15, manifold box 510 comprises hand pump connection 511. Hand pump connection 511 is conventional, and also provides conventional needle valve functionality which may be actuated to shut down pressure to or from manifold box 510 as required. Manifold box 510 also comprises a plurality of conventional hose connections 512, each in internal fluid communication with hand pump connection 511. As shown on FIG. 13, for example, hose 515 connects one of the hose connections 512 to quick test port 500. Hose connections 512 not in use may be sealed using a conventional threaded plug.

FIGS. 16 and 17 illustrate one embodiment of a smaller cam lock assembly 600, suitable for smaller wellheads. FIGS. 16 and 17 should be viewed together. The embodiments of cam lock assembly 600 on FIGS. 16 and 17 should also be compared with the embodiments of pressure control assembly 200 on FIGS. 2 through 15, where it will be appreciated that cam lock assembly 600 is less of a flanged connection design, and is thus thinner in profile. Also, the linkage of cam lock pistons 622 through to cam locks 620 on cam lock assembly 600 is different from the corresponding parts on pressure control assembly 200, and more suited to a cam lock assembly 600's thinner profile. As a result, cam lock curvatures 625 and corresponding shoulder 654 on adapter 650 on cam lock assembly 600 are shaped differently to suit the alternative design. Other distinctions between cam lock assembly 600 on FIGS. 16 and 17 and pressure control assembly 200 on FIGS. 2 through 15 will become apparent in view of the following description of FIGS. 16 and 17. However, it will be nonetheless appreciated that the scope of this disclosure with respect to cam lock seals is not limited to the exemplary cam lock pressure control assemblies 200 and 600 illustrated on FIGS. 1 through 17. It will be understood that other embodiments, not illustrated, may provide yet larger or yet smaller cam lock pressure control assemblies, each having similar functionality of cam lock pressure control assemblies 200 and 600 disclosed in detail herein. For example, it will be appreciated that both cam lock pressure control assemblies 200 and 600 provide six (6) cam lock assemblies to maintain the high pressure seal, and two (2) locking ring pistons to control positioning of the locking ring. Other embodiments, not illustrated, having larger or smaller overall diameters, may provide a greater or fewer number of cam lock assemblies to maintain the high pressure seal. Other embodiments may provide different cam lock shapes and linkage designs or different seal designs at the intersection of the PCE adapter and wellhead receptacle. Other embodiments may control the locking ring differently, or not provide a locking ring at all.

With reference now to FIGS. 16 and 17, an isometric section of cam lock assembly 600 is depicted on FIG. 16, and an exploded view of cam lock assembly 600 is depicted on FIG. 17. Cam lock assembly 600 is depicted on FIG. 16 in the locked position with locking ring 640 positioned to retain cam locks 620 and link arms 635 in such locked position. Hydraulic base 690 and upper body 680 are received over and affixed onto receptacle 660, with upper body 680 positioned above hydraulic base 690 (i.e., with upper body 680 positioned closer to the entry point of adapter 650 into receptacle 660). Tulip 601 is affixed to and above upper body 680. As with the corresponding part 201 for pressure control assembly 200 depicted on FIG. 6, for example, tulip 601 on FIG. 16 assists guiding adapter 650 into cam lock assembly 600 and onto receptacle 660.

With continuing reference to FIG. 16, hydraulic base 690 provides cam lock pistons 622 and locking ring pistons 642 oriented to extend and retract upwards (i.e., towards and away from the entry point of adapter 650 into receptacle 660). Ports 691 in hydraulic base 690 supply hydraulic fluid to and from cam lock pistons 620 and locking ring pistons 642. Extension and retraction of cam lock pistons 622 causes cam locks 620 to rotate via link arms 635 and operate through apertures provided in upper body 680 (such apertures in upper body 680 depicted clearly on FIG. 17). Extension and retraction of locking ring pistons 642 causes locking ring 640 to disengage and engage from retention of cam locks 620 and link arms 635 when cam locks 620 are in the locked position (such locked position depicted on FIG. 16).

Comparison of FIG. 16 should now be made with FIG. 10, in which pressure control assembly 200 is also shown in its locked position. It will be seen that the details of the high pressure seal at the engagement of adapter 650 and receptacle 660 on FIG. 16 is functionally the same as the corresponding engagement of adapter 250 and receptacle 260 on FIG. 10. On FIG. 16, when cam lock pistons 622 are fully extended, cam curvatures 625 engage and bear down on shoulder 654 formed in adapter 650. Cooperating abutment surfaces at the contact interface of adapter 650 and receptacle 660 are compressed together to form a high pressure seal. Such cooperating abutment surfaces include seat surface 655 and slope surface 656 on adapter 650, which although not illustrated in detail on FIGS. 16 and 17 will be understood to correspond to seat surface 255 and slope surface 256 depicted on FIG. 10.

As with the embodiment of pressure control assembly 200 described above with reference to FIG. 10, the action of locking ring 640 to secure cam locks 620 on FIG. 16 is primarily for safety purposes, to prevent cam locks 620 from becoming disengaged from shoulder 654 on adapter 650 in the event of a loss in hydraulic pressure (or other event) potentially compromising the high pressure seal between adapter 650 and receptacle 660.

FIGS. 18 through 20 illustrate one embodiment of a spring-driven ball race seal assembly 700 for providing a high pressure seal for wellhead pressure control fittings. FIGS. 18 through 20 should be viewed together. FIG. 18 is an isometric section view of ball race seal assembly 700, and FIG. 20 is an exploded view of FIG. 18. FIG. 18 depicts ball race seal assembly 700 in the locked position. FIGS. 19A and 19B are freeze-frame views of ball race seal assembly 700 in partial section, illustrating ball race seal assembly 700 in its unlocked position (FIG. 19A) and locked position (FIG. 19B). For clarity on FIGS. 18 through 20, and to reduce clutter on the drawings, conventional sealing parts such as o-rings are either shown but not called out as separate parts, or are omitted altogether.

Referring first to FIG. 18, receptacle 760 is generally tubular and provides an exterior annular cutout at a first end that forms an elongate receptacle sealing portion 762 at the first end. A second end of receptacle 760 provides a flange or other suitable connection to a wellhead, or to equipment interposed between receptacle 760 and the wellhead. PCE adapter 750 is also generally tubular and provides a suitable connection, such as a threaded connection, to pressure control equipment (PCE) at a first end. Adapter 750 further provides an interior annular cutout at a second end that forms an elongate adapter sealing portion 752 at the second end. Adapter sealing portion 752 and receptacle sealing portion 762 are shaped and dimensioned such that when adapter sealing portion 752 is received over receptacle sealing portion 762 and constrained radially outwards, a pressure seal is formed between adapter sealing portion 752 and receptacle sealing portion 762. o-rings 761 facilitate the seal.

Lower body 710 is generally tubular, and is received over and affixed to the exterior of receptacle 760 via threading or other suitable connection. Lower body 710 has first and second ends, and is affixed at its second end to receptacle 760. The first end of lower body 710 extends parallel with receptacle sealing portion 762 and is positioned to constrain adapter sealing portion 752 radially when adapter sealing portion 752 is in sealing engagement with receptacle sealing portion 762.

Referring momentarily to FIG. 20, ball race cylinder 720 provides holes 722 to receive ball bearings 721 and retain them externally. It will be understood that although holes 722 are small enough to retain ball bearings 721 externally, ball bearings 721 may nonetheless roll freely within holes 722 while protruding internally through holes 722. Referring again now to FIG. 18, ball race cylinder has first and second ends. The second end of ball race cylinder 720 (including ball bearings 721) is positioned at the first end of lower body 710 such that ball bearings 721, when protruding internally through holes 722, roll against an exterior surface of adapter 750 as adapter sealing portion 752 is brought to engage over receptacle sealing portion 762. The exterior surface of adapter 750 further provides annular adapter grooves 751 that are positioned and dimensioned to receive ball bearings 721 (as ball bearings 721 protrude internally through holes 722) when adapter sealing portion 752 is fully engaged over receptacle sealing portion 762. Adapter grooves 751 are further positioned, sized and shaped such that adapter sealing portion 752 is locked in sealing engagement with receptacle sealing portion 762 when ball bearings 721 are compressed into adapter grooves 751.

Floating member 730 is generally tubular and is received over lower body 710 and ball race cylinder 720. Floating member 730 has first and second ends. The first end of floating member 730 retains ball bearings 721 in holes 722, while the interior of the second end of floating member 730 is in sealing engagement with the exterior of lower body 710. The first end of floating member 730 further provides a thickened floating member locking portion 731 which, when engaged on ball bearings 721, compresses ball bearings 721 into adapter grooves 751.

Sleeve 770 is generally tubular and is received over ball race cylinder 720, floating member 730 and lower body 710. Sleeve 770 has first and second ends. The second end of sleeve 770 is affixed to the exterior of the second end of lower body 710 by threading or other suitable connection. The first end of sleeve 770 is further positioned, dimensioned and shaped to be in sealing engagement with the first end of ball race cylinder 720. With reference now to FIG. 20, sleeve 700 has an interior annular sleeve cavity 771 formed therein. With reference now to FIG. 18, floating member 730 resides within sleeve cavity 771 so as to create a sealed annular upper chamber 740 above the first end of floating member 730 and a sealed annular lower chamber 745 below the second end of floating member 730. Upper and lower chamber ports 741 and 746 are provided in sleeve 770 to supply hydraulic fluid to and from upper and lower chambers 740 and 745 respectively. Compression spring 735 resides in upper chamber 740 and is biased to encourage floating member 730 to a position farthest away from the first end of sleeve 770.

FIGS. 19A and 19B illustrate the operation of ball race seal assembly 700 from an unlocked position in FIG. 19A to a locked position in FIG. 19B. In FIG. 19A, hydraulic fluid is introduced through lower chamber port 746 (and denoted by the large arrow on FIG. 19A) and pressurizes lower chamber 745, moving floating member 730 towards the first end of sleeve 770 in the direction of the small vertical arrow on FIG. 19A and against the bias of compression spring 735. Thickened floating member locking portion 731 of locking member 730 is disengaged from ball bearings 721, allowing ball bearings 721 to displace radially outwards in the direction of the small horizontal arrows on FIG. 19A. At this time, adapter 750 is free to be brought into engagement with receptacle 760, such that adapter sealing portion 752 may form a seal over receptacle sealing portion 762, while also being constrained radially by lower body 710.

Turning now to FIG. 19B, adapter sealing portion 752 is now fully engaged over receptacle sealing portion, and adapter grooves 751 are now positioned adjacent to ball bearings 721. Hydraulic fluid is introduced through upper chamber port 741 (and denoted by the large arrow on FIG. 19B) and pressurizes upper chamber 740, moving floating member 730 towards the second end of sleeve 770 in the direction of the small vertical arrow on FIG. 19B and assisted by the bias of compression spring 735. Thickened floating member locking portion 731 of locking member 730 engages ball bearings 721, compressing ball bearings 721 into adapter grooves in the direction of the small horizontal arrows on FIG. 19B, and thereby locking adapter sealing portion 752 in sealing engagement with receptacle sealing portion 762.

FIGS. 21 through 28 illustrate two embodiments of a wedge seal design for providing a high pressure seal for wellhead pressure control fittings. FIGS. 21 through 24 illustrate a first embodiment, wedge seal assembly 800, in which opposing sloped sides of wedges are driven in reciprocating motion directly by hydraulic fluid pressure. FIGS. 25 through 28 illustrate a second embodiment, wedge seal assembly 900, in which the opposing sloped sides of the wedges are driven by hydraulically-actuated pistons.

Figure 21:
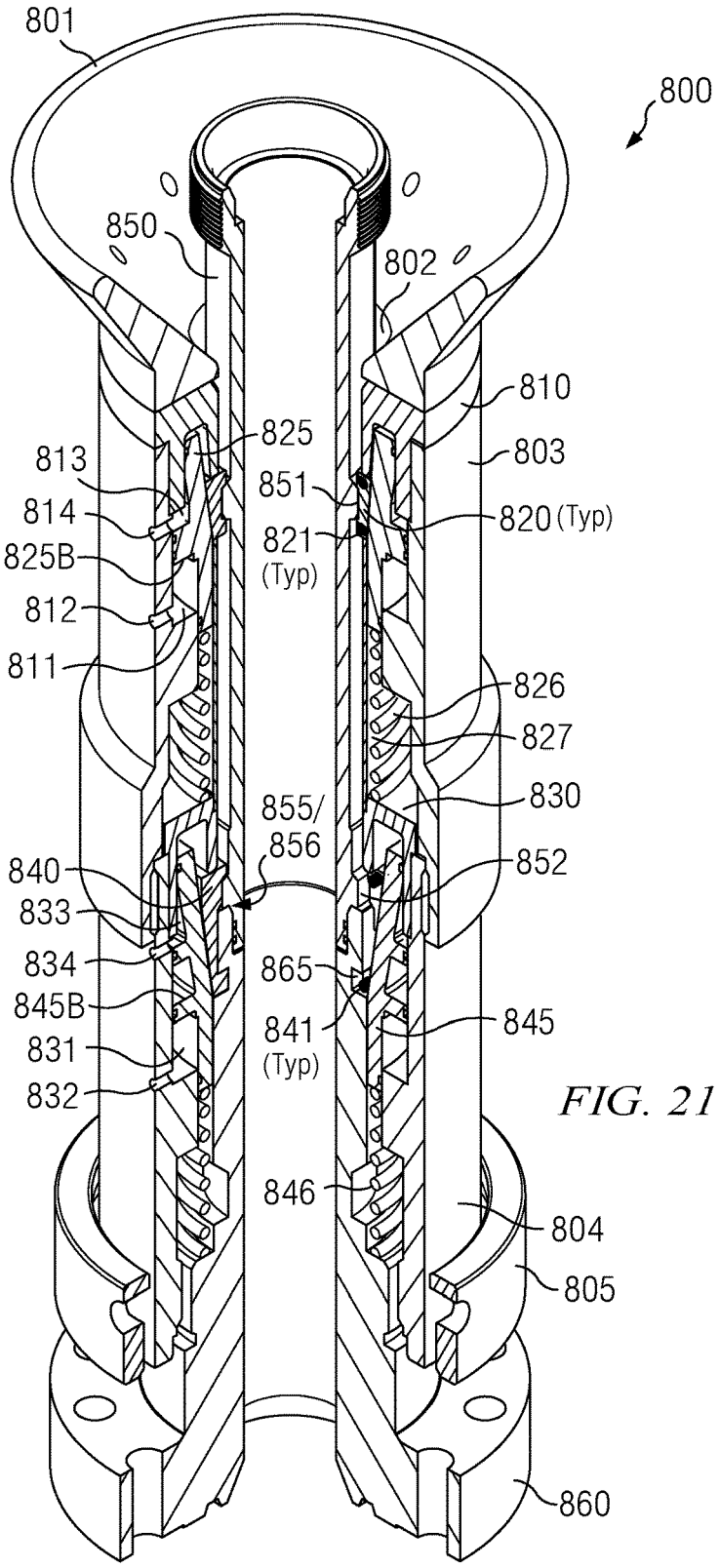
Figure 22A:
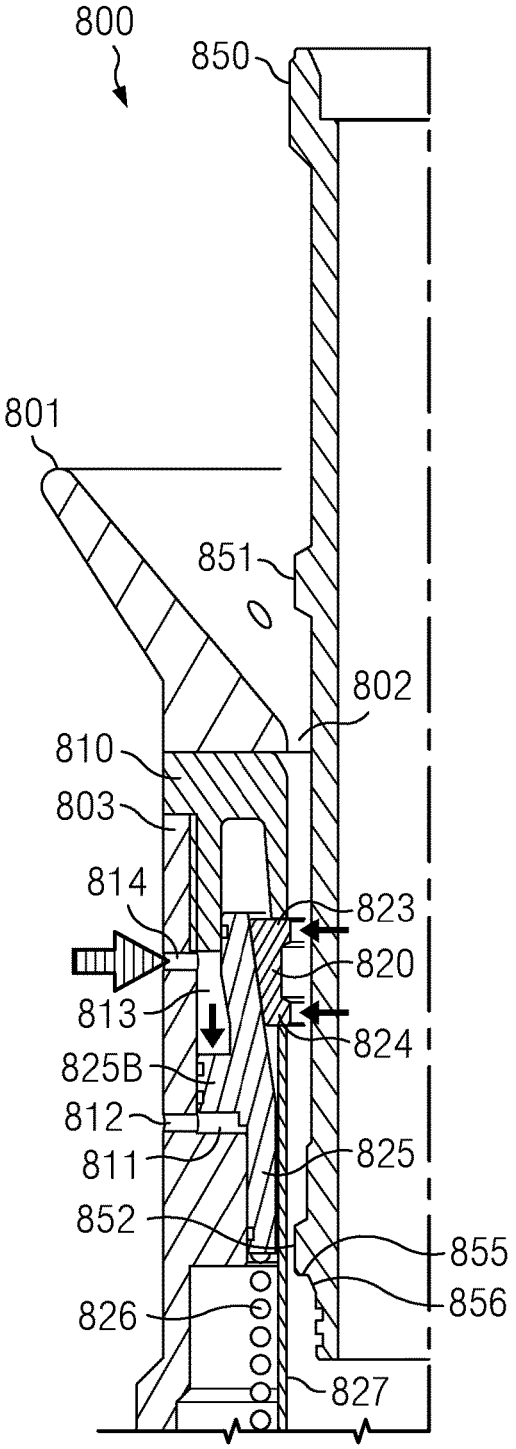
FIGS. 22A and 22B are partial section views of an upper end of the first wedge seal embodiment in an unlocked position and a locked position respectively.
Figure 22B:
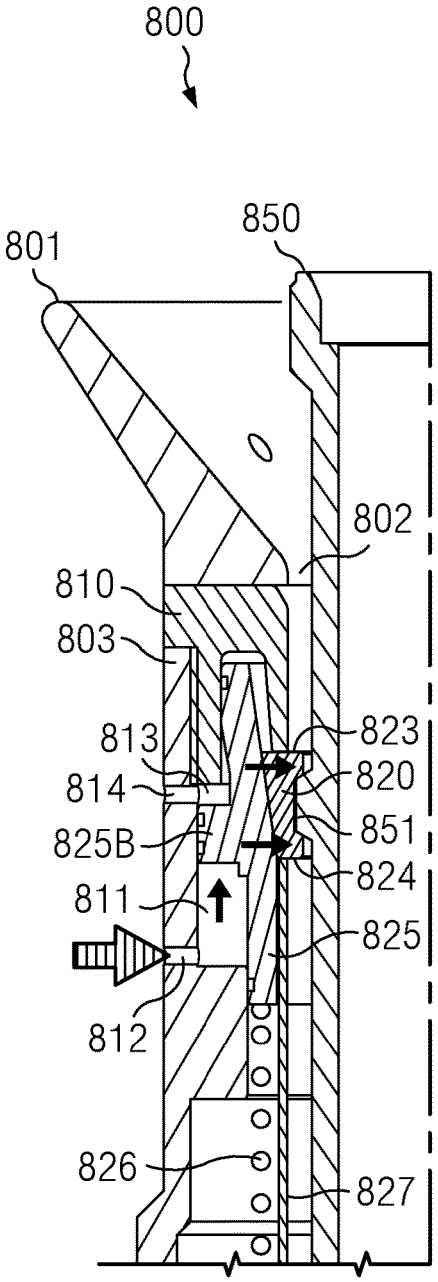
Figure 23A:
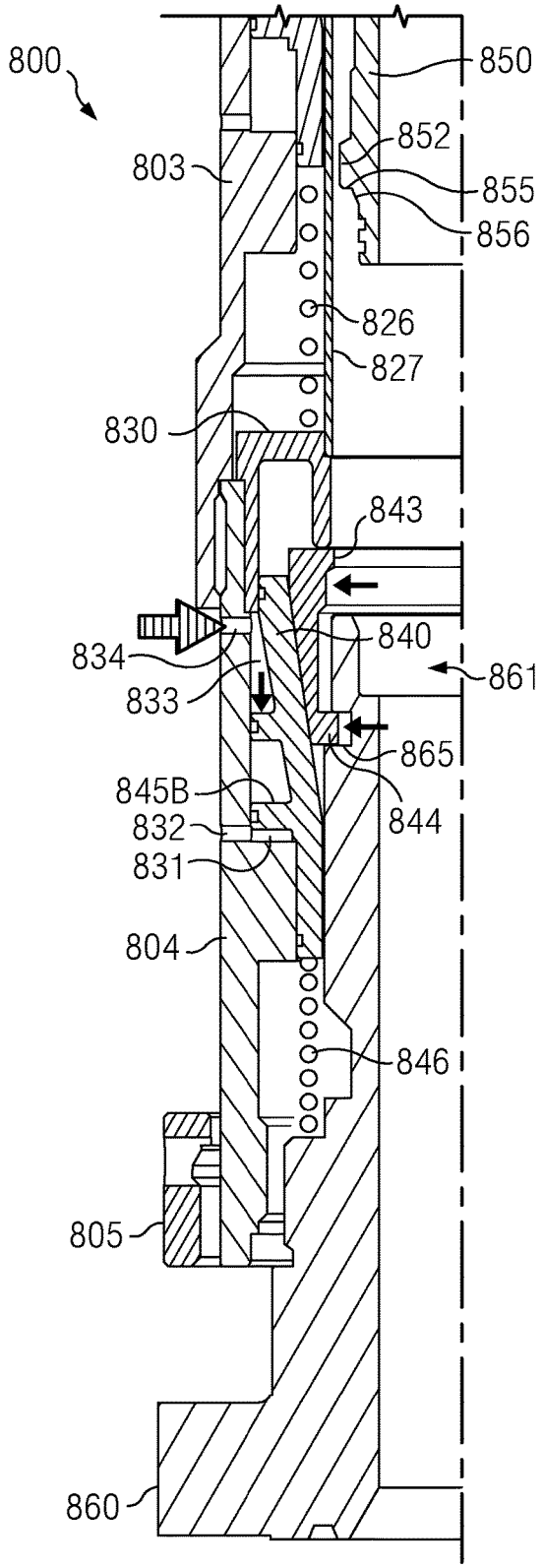
FIGS. 23A and 23B are partial section views of a lower end of the first wedge seal embodiment in an unlocked position and a locked position respectively.
Figure 23B:
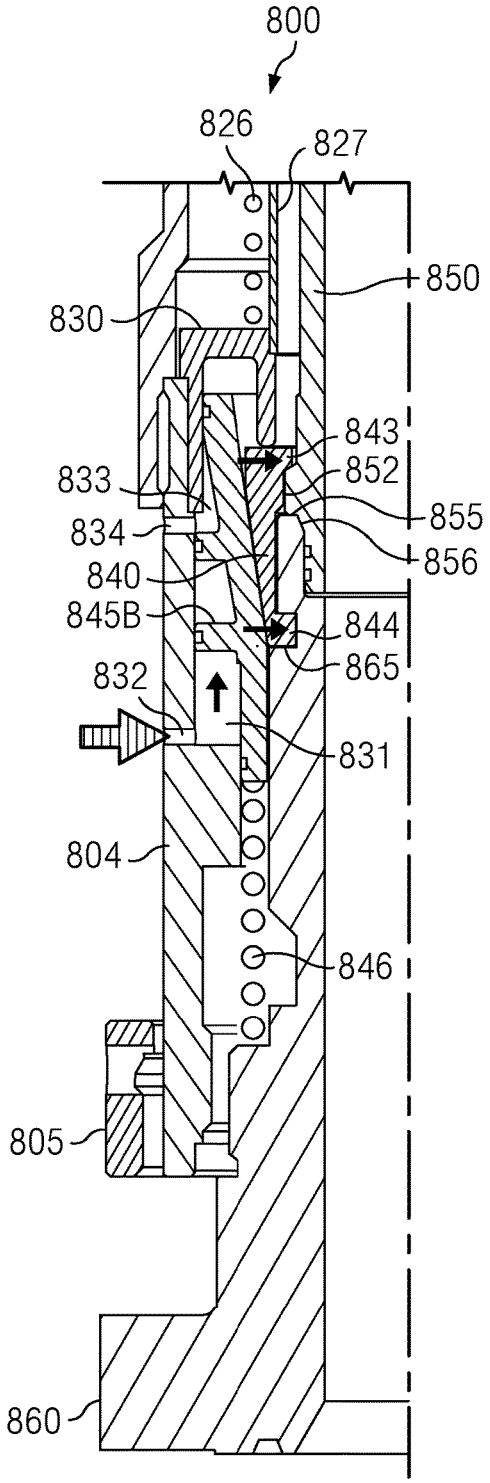
Figure 24:
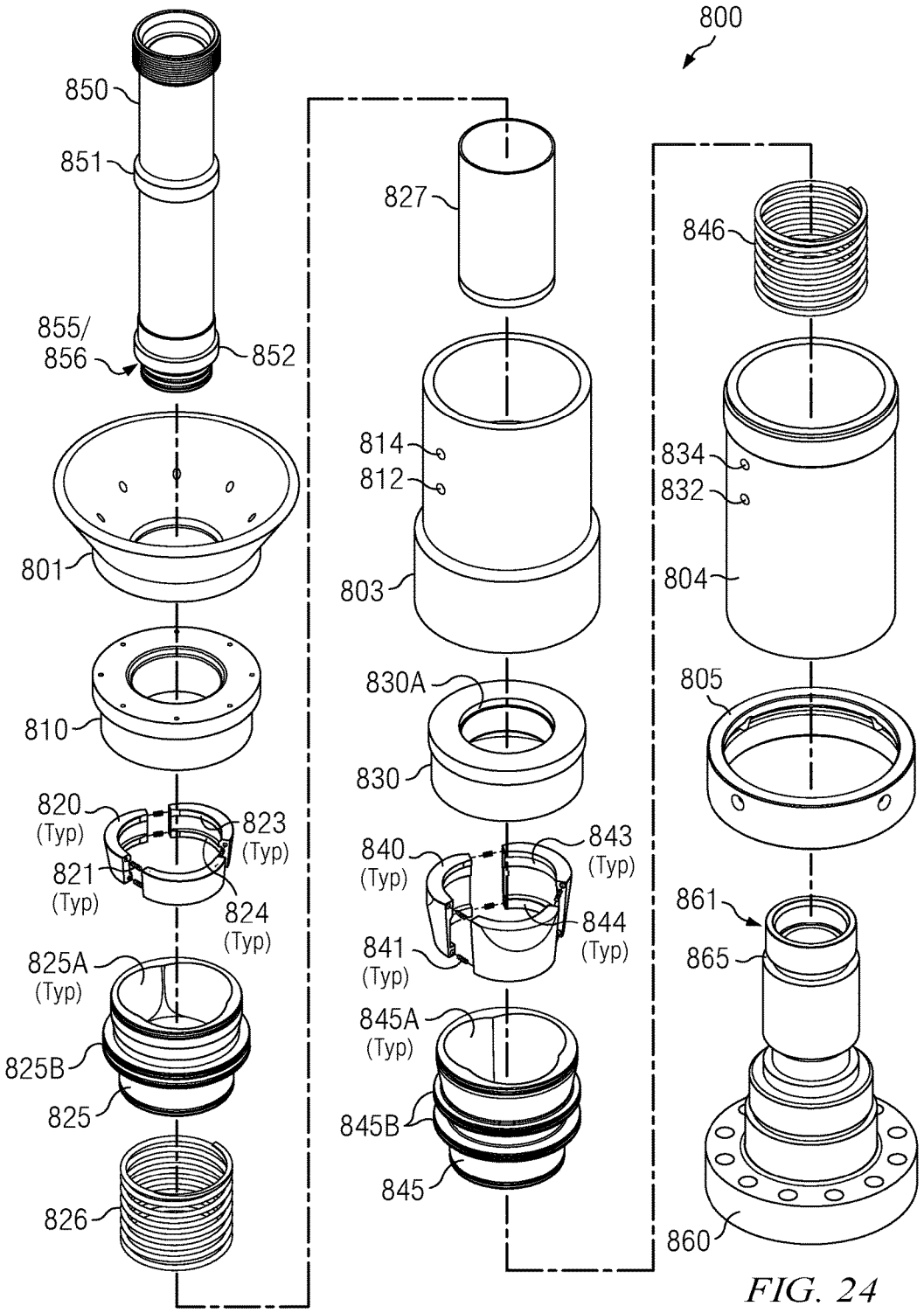

Turning first to FIGS. 21 through 24, wedge seal assembly 800 is illustrated for providing a high pressure seal for wellhead pressure control fittings. FIGS. 21 through 24 should be viewed together. FIG. 21 is an isometric section view of wedge seal assembly 800, and FIG. 24 is an exploded view of FIG. 21. FIG. 21 depicts wedge seal assembly 800 in the locked position. FIGS. 22A and 22B are freeze-frame views of wedge seal assembly 800 in partial section at the upper end, illustrating engagement of upper adapter rib 851 on adapter 850. FIG. 22A illustrates wedge seal assembly 800 in its unlocked position prior to engagement of upper adapter rib 851 and FIG. 22B illustrates wedge seal assembly 800 in its locked position over upper adapter rib 851. FIGS. 23A and 23B are freeze-frame views of wedge seal assembly 800 in partial section at the lower end, illustrating engagement of lower adapter rib 852 on adapter 850. FIG. 23A illustrates wedge seal assembly 800 in its unlocked Position prior to engagement of lower adapter rib 852 and FIG. 23B illustrates wedge seal assembly 800 in its locked position over lower adapter rib 852. For clarity on FIGS. 21 through 24, and to reduce clutter on the drawings, conventional sealing parts such as o-rings are either shown but not called out as separate parts, or are omitted altogether. Further, not all parts on wedge seal assembly 800 are shown on freeze-frame FIGS. 22A through 23B. Some parts have been omitted for clarity on FIGS. 22A through 23B so that the unlocking and locking mechanisms of wedge seal assembly 800 can be appreciated more clearly.

By way of introduction to wedge seal assembly 800 in more detail, FIGS. 23A and 23B illustrate that the high pressure seal between adapter 850 and receptacle 860 is functionally analogous to the high pressure seal between adapter 250 and receptacle 260 described above with reference to FIGS. 8 through 10. Referring to FIGS. 23A and 23B, adapter 850 provides machined surfaces on seat surface 855 and slope surface 856. Receptacle 860 also provides corresponding machined surfaces shaped to match seat surface 855 and slope surface 856 at a first (distal) end 861 thereof. It will be appreciated that analogous to FIGS. 8 through 10 as described above for pressure control assembly 200, compression of adapter 850 into receptacle 860 on wedge seal assembly 800 as depicted on FIGS. 23A and 23B enables a machined surface metal-to-metal seal at seat surface 855 and slope surface 856.

A primary distinction between the embodiment of wedge seal assembly 800 (as depicted on FIGS. 23A and 23B) over the embodiment of pressure control assembly 200 (as depicted on FIGS. 8 through 10) arises in the mechanism by which wedge seal assembly 800 compresses adapter 850 into receptacle 860 to form a high pressure seal. With reference first to FIG. 23B, when adapter 850 is received into seal engagement with receptacle 860, lower adapter rib 852 is presented for engagement with lower wedge 840. Lower wedge 840 provides lower wedge top and bottom ribs 843 and 844. Hydraulic fluid is introduced under pressure through lower engage port 832 into lower engage chamber 831, as denoted by the large arrow on FIG. 23B. Pressurization of lower engage chamber 831 causes movement of lower wedge receptacle 845 in the direction of the small vertical arrow on FIG. 23B (i.e., in a direction away from the wellhead), assisted by the bias of lower compression spring 846. This movement of lower wedge receptacle 845 compresses lower wedge 840 radially against the engagement of adapter 850 and receptacle 860, in the direction of the small horizontal arrows on FIG. 23B. Lower wedge top rib 843 locks over lower adapter rib 852 and lower wedge bottom rib 844 locks into wedge groove 865 provided in receptacle 860.

Referring now to FIG. 23A, the release of the high pressure seal enabled by wedge seal assembly 800 is substantially the reverse of the disclosure immediately above describing FIG. 23B. Hydraulic fluid is introduced under pressure through lower release port 834 into lower release chamber 833, as denoted by the large arrow on FIG. 23A. It will be understood that at the same time, hydraulic fluid pressure is released in lower engage chamber 831 through lower engage port 832. Pressurization of lower release chamber 833 causes movement of lower wedge receptacle 845 in the direction of the small vertical arrow on FIG. 23A (i.e., in a direction towards the wellhead), against the bias of lower compression spring 846. This movement of lower wedge receptacle 845 releases lower wedge 840 from its engagement of lower adapter rib 852 and wedge groove 865, in the direction of the small horizontal arrows on FIG. 23A. Adapter 850 and receptacle 860 are now free to separate, releasing the high pressure seal between them.

It will be appreciated that first from reference to FIG. 21, and then to FIGS. 22A and 22B, the high pressure seal provided by wedge seal assembly 800 is assisted by a locking mechanism further above the seal, where upper adapter rib 851 is engaged by upper wedge 820. For the avoidance of doubt, it should be understood that the engagement of upper adapter rib 851 per FIGS. 22A and 22B is not a seal, but a lock that holds adapter 850 in sealing engagement with receptacle 860 as described immediately above with reference to FIGS. 23A and 23B. It will be therefore necessarily understood that in the embodiment of wedge seal assembly 800 illustrated on FIGS. 21 through 24, upper adapter rib 851 may be engaged and released by upper wedge 820 independently of the engagement and release of lower adapter rib 852 by lower wedge 840.

With reference now to FIGS. 22B and 23B, when adapter 850 is received into seal engagement with receptacle 860, upper adapter rib 851 is presented for engagement with upper wedge 820. Upper wedge 820 provides upper wedge top and bottom ribs 823 and 824. Hydraulic fluid is introduced under pressure through upper engage port 812 into upper engage chamber 811, as denoted by the large arrow on FIG. 22B. Pressurization of upper engage chamber 811 causes movement of upper wedge receptacle 825 in the direction of the small vertical arrow on FIG. 22B (i.e., in a direction away from the wellhead), assisted by the bias of upper compression spring 826. This movement of upper wedge receptacle 825 compresses upper wedge 820 radially against upper adapter rib 851, in the direction of the small horizontal arrows on FIG. 22B. Upper wedge top and bottom ribs 823 and 824 lock over upper adapter rib 851 and further restrain adapter 850 from movement relative to the high pressure seal below (seal shown on FIG. 23B).

Referring now to FIG. 22A, the release of the locking mechanism over upper adapter rib 851 is substantially the reverse of the disclosure immediately above describing FIG. 22B. Hydraulic fluid is introduced under pressure through upper release port 814 into upper release chamber 813, as denoted by the large arrow on FIG. 22A. It will be understood that at the same time, hydraulic fluid pressure is released in upper engage chamber 811 through upper engage port 812. Pressurization of upper release chamber 813 causes movement of upper wedge receptacle 825 in the direction of the small vertical arrow on FIG. 22A (i.e., in a direction towards the wellhead), against the bias of upper compression spring 826. This movement of upper wedge receptacle 825 releases upper wedge 820 from its engagement of upper adapter rib 851, in the direction of the small horizontal arrows on FIG. 22A.

Referring now to FIGS. 21 and 24, wedge seal assembly 800 comprises a generally tubular receptacle 860 that provides an exterior annular wedge groove 865 at a first end 861 thereof. A second end of receptacle 860 provides a flange or other suitable connection to a wellhead, or to equipment interposed between receptacle 860 and the wellhead. PCE adapter 850 is also generally tubular and, provides a suitable connection, such as a threaded connection, to pressure control equipment (PCE) at a first end. Adapter 850 further provides a lower adapter rib 852 at a second end proximate machined seal surfaces including seat surface 855 and 856. As described above with respect to FIG. 23B, the high pressure seal between adapter 850 and receptacle 860 is functionally analogous to the high pressure seal between adapter 250 and receptacle 260 described above with reference to FIGS. 8 through 10.

Lower wedge receptacle 845 is generally cylindrical and is received over the first end 861 of receptacle 860. Lower wedges 840 are received into shaped recesses 845A in lower wedge receptacle 845 and are positioned around the first end 861 of receptacle 860. Three (3) lower wedges 840 are illustrated on FIGS. 21 and 24, although the scope of this disclosure is not limited in this regard. Lower wedges 840 are separated and kept in circumferential bias by lower wedge separator springs 841. Six (6) lower wedge separator springs 841 are illustrated on FIGS. 21 and 24, although again, the scope of this disclosure is not limited in this regard. Shaped recesses 845A and lower wedges 840 present opposing sloped surfaces such that lower wedges 840 are caused to constrict and expand radially within lower wedge receptacle 845 responsive to axial displacement of lower wedge receptacle 845 relative to lower wedges 840. Each lower wedge 840 further provides lower wedge top and bottom ribs 843 and 844. Lower wedge top rib 843 is shaped and positioned to be received over lower adapter rib 852 when adapter 850 is sealingly received into receptacle 860. Lower wedge bottom rib 844 is shaped and positioned to be received into wedge groove 865 on receptacle 860 when adapter 850 is sealingly received into receptacle 860.

Lower compression spring 846 is received over receptacle 860 and interposed between lower wedge receptacle 845 and the second end of receptacle 860. Lower compression spring 846 is biased to encourage radial constriction of lower wedges 840 via axial displacement of lower wedge receptacle 845 relative to lower wedges 840.

Lower sleeve 804 is generally tubular and is received over lower wedge receptacle 845 and lower compression spring 846. Exterior ribs 845B on lower wedge receptacle 845 sealingly engage with lower sleeve 804. Two (2) exterior ribs 845B are illustrated on FIGS. 21 and 24, although the scope of this disclosure is not limited in this regard. Lower sleeve 804 has first and second ends. The second end of lower sleeve 804 is affixed to the exterior of the second end of receptacle 860 by threading or other suitable connection, and is advantageously further secured in place by securement ring 805. The first end of lower sleeve 804 sealingly engages with lower roof member 830. Lower roof member 830 also contacts lower wedge top ribs 843. Lower engage chamber 831 is formed by lower wedge receptacle 845 (including exterior ribs 845B), lower sleeve 804 and receptacle 860. Lower engage port 832 supplies and drains lower engage chamber 831 with hydraulic fluid. Lower release chamber 833 is formed by lower wedge receptacle 845 (including exterior ribs 845B), lower sleeve 804 and lower roof member 830. Lower release port 834 supplies and drains lower release chamber 833 with hydraulic fluid.

With continuing reference to FIGS. 21 and 24, compression spring retainer sleeve 827 is generally cylindrical and has first and second ends. The second end of compression spring retainer sleeve 827 is received into an interior annular recess 830A in lower roof member 830. Upper wedge receptacle 825 is received over the first end of compression spring retainer sleeve 827. Upper wedges 820 are received into shaped recesses 825A in upper wedge receptacle 825. Three (3) upper wedges 820 are illustrated on FIGS. 21 and 24, although the scope of this disclosure is not limited in this regard. Upper wedges 820 are separated and kept in circumferential bias by upper wedge separator springs 821. Six (6) upper wedge separator springs 821 are illustrated on FIGS. 21 and 24, although again, the scope of this disclosure is not limited in this regard. Shaped recesses 825A and upper wedges 820 present opposing sloped surfaces such that upper wedges 820 are caused to constrict and expand radially within upper wedge receptacle 825 responsive to axial displacement of upper wedge receptacle 825 relative to upper wedges 820. Each upper wedge 820 further provides upper wedge top and bottom ribs 823 and 824. Upper wedge top and bottom ribs 823 and 824 are shaped and positioned to enable upper wedges 820 to constrict around and restrain upper adapter rib 851 when adapter 850 is sealingly received into receptacle 860.

Upper compression spring 826 is received over compression spring retainer sleeve 827 and interposed between upper wedge receptacle 825 and lower roof member 830. Upper compression spring 826 is biased to encourage radial constriction of upper wedges 820 via axial displacement of lower wedge receptacle 825 relative to lower wedges 820.

Upper sleeve 803 is generally tubular and is received over upper wedge receptacle 825 and upper compression spring 826. Exterior rib 825B on upper wedge receptacle 825 sealingly engages with upper sleeve 803. One (1) exterior rib 825B is illustrated on FIGS. 21 and 24, although the scope of this disclosure is not limited in this regard. Upper sleeve 803 has first and second ends. The second end of upper sleeve 803 is sealingly affixed to the exterior of the first end of lower sleeve 804 by threading plus gasket, or other suitable connection. The first end of upper sleeve 803 is sealingly engaged to upper roof member 810. Upper roof member 810 also contacts upper wedge top ribs 823. Upper engage chamber 811 is formed by upper wedge receptacle 825 (including exterior rib 825B) and upper sleeve 803. Upper engage port 812 supplies and drains upper engage chamber 811 with hydraulic fluid. Upper release chamber 813 is formed by upper wedge receptacle 825 (including exterior rib 825B), upper sleeve 803 and upper roof member 810. Upper release port 814 supplies and drains upper release chamber 813 with hydraulic fluid.

Upper roof member 810 is affixed to tulip 801. Tulip 801 provides tulip clearance 802 sufficient to allow upper and lower adapter ribs 851 and 852 on adapter 850 to pass through tulip 801.

Figure 25:
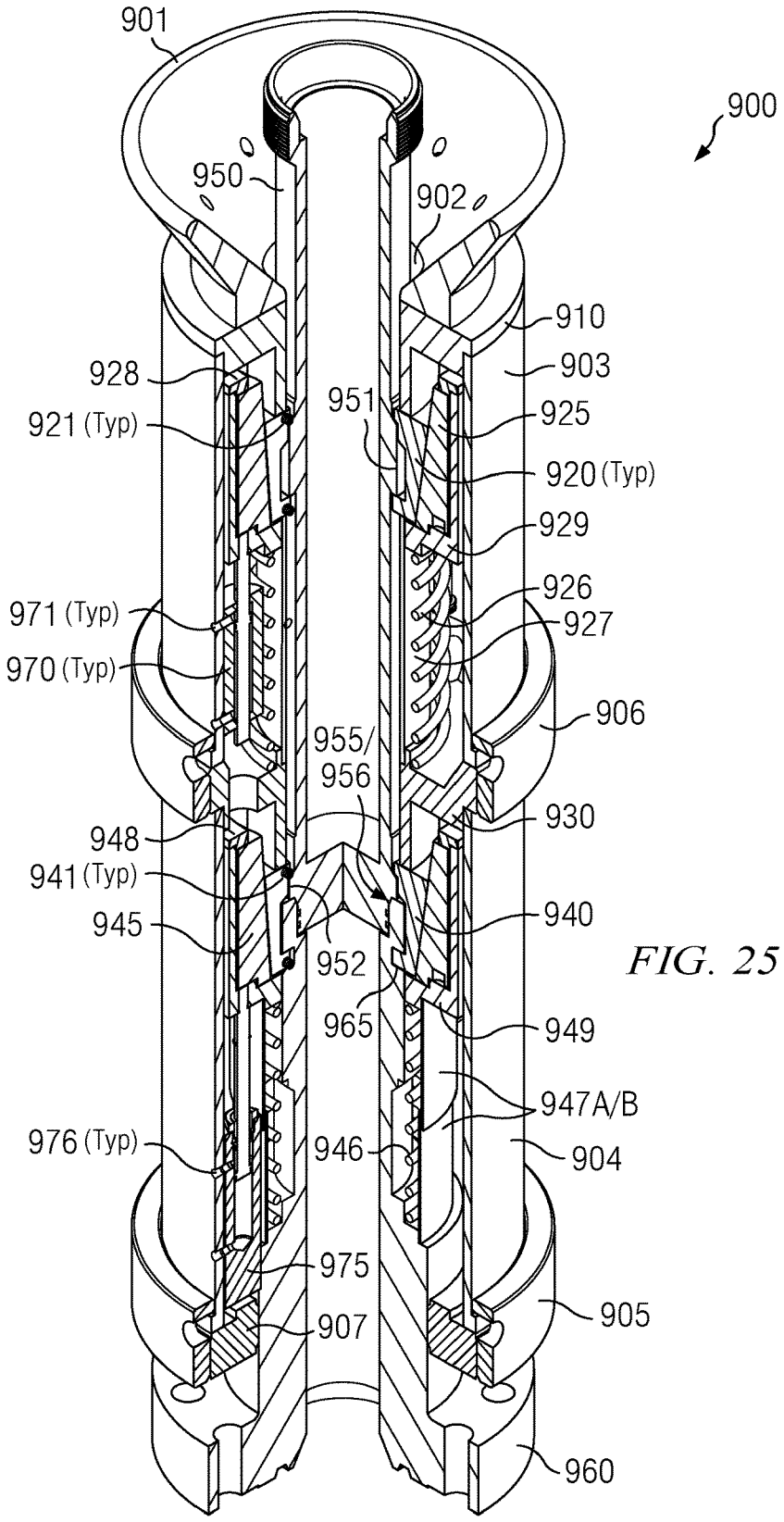
Figure 26A:
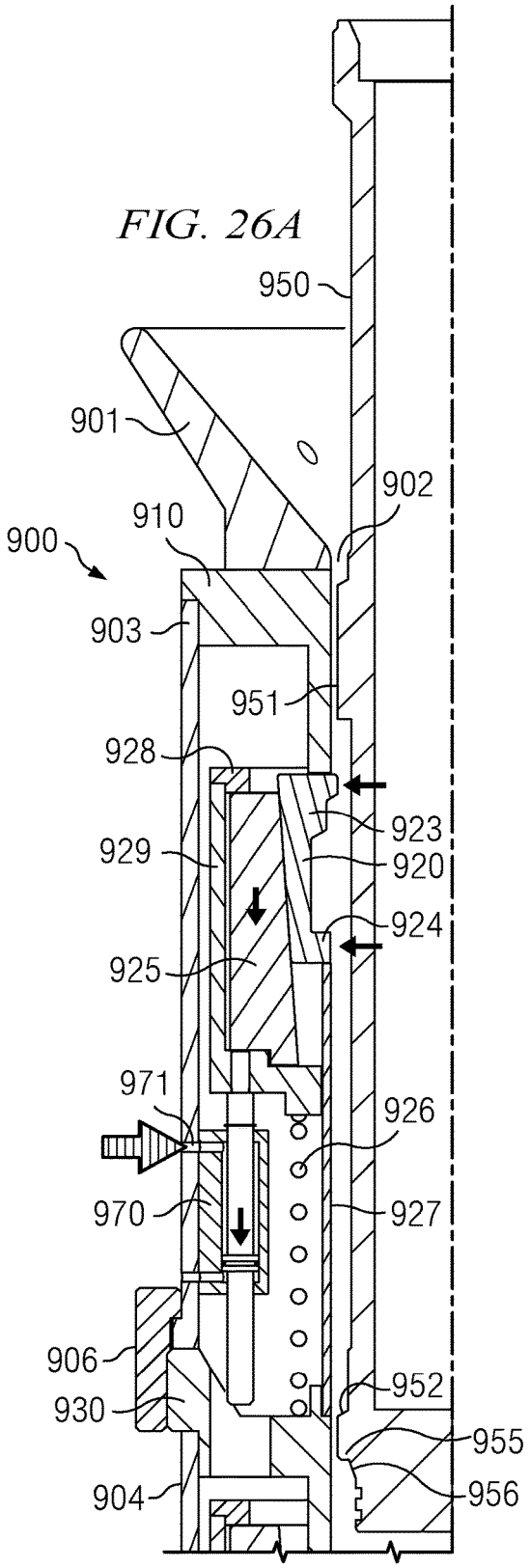
FIGS. 26A and 26B are partial section views of an upper end of the second wedge seal embodiment in an unlocked position and a locked position respectively.
Figure 26B:
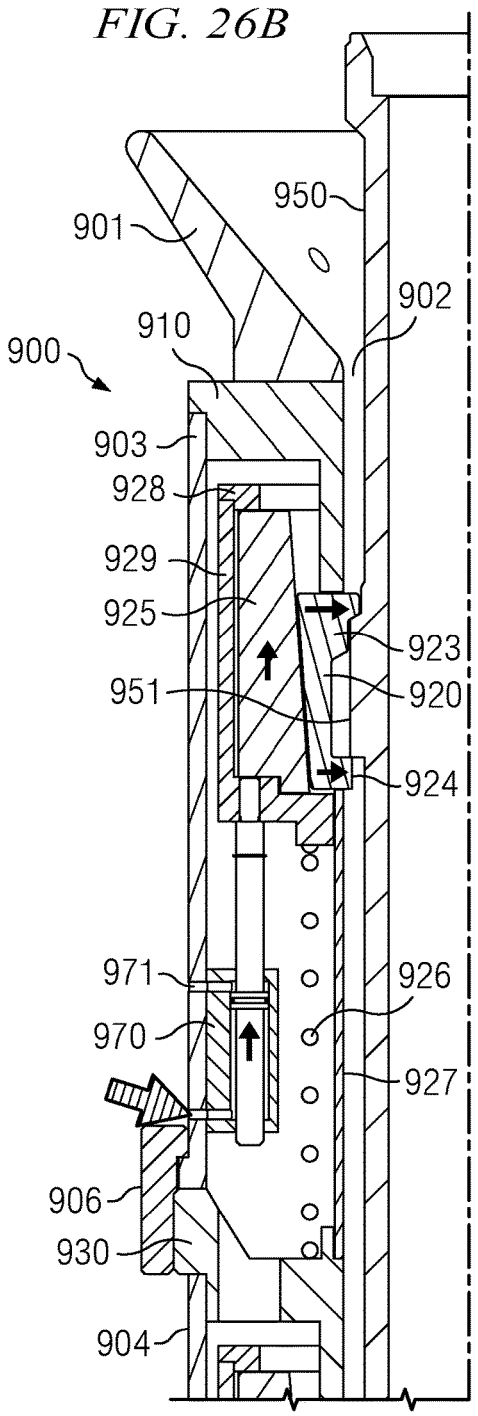
Figure 27A:
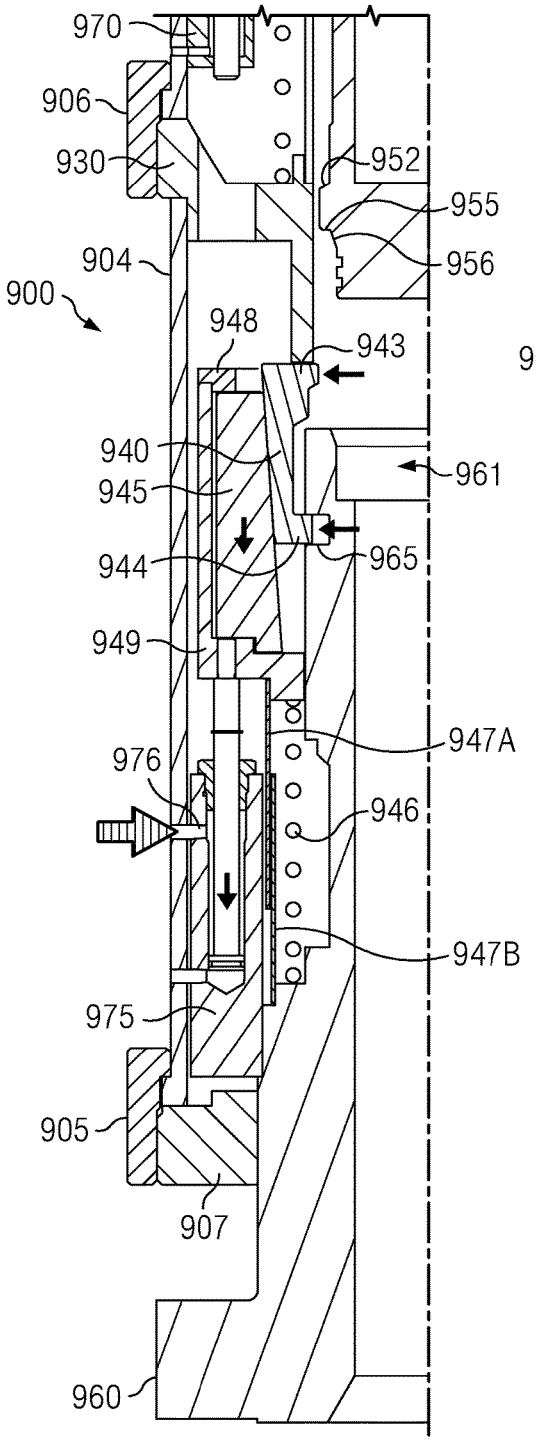
FIGS. 27A and 27B are partial section views of a lower end of the second wedge seal, embodiment in an unlocked position and a locked position respectively.
Figure 27B:
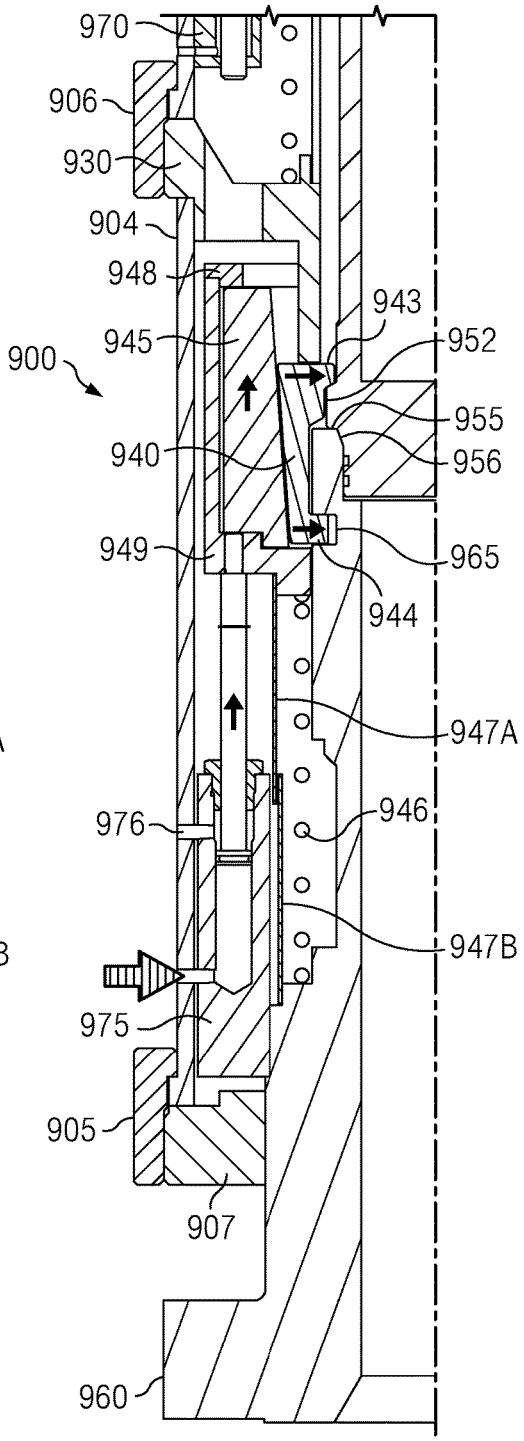
Figure 28:
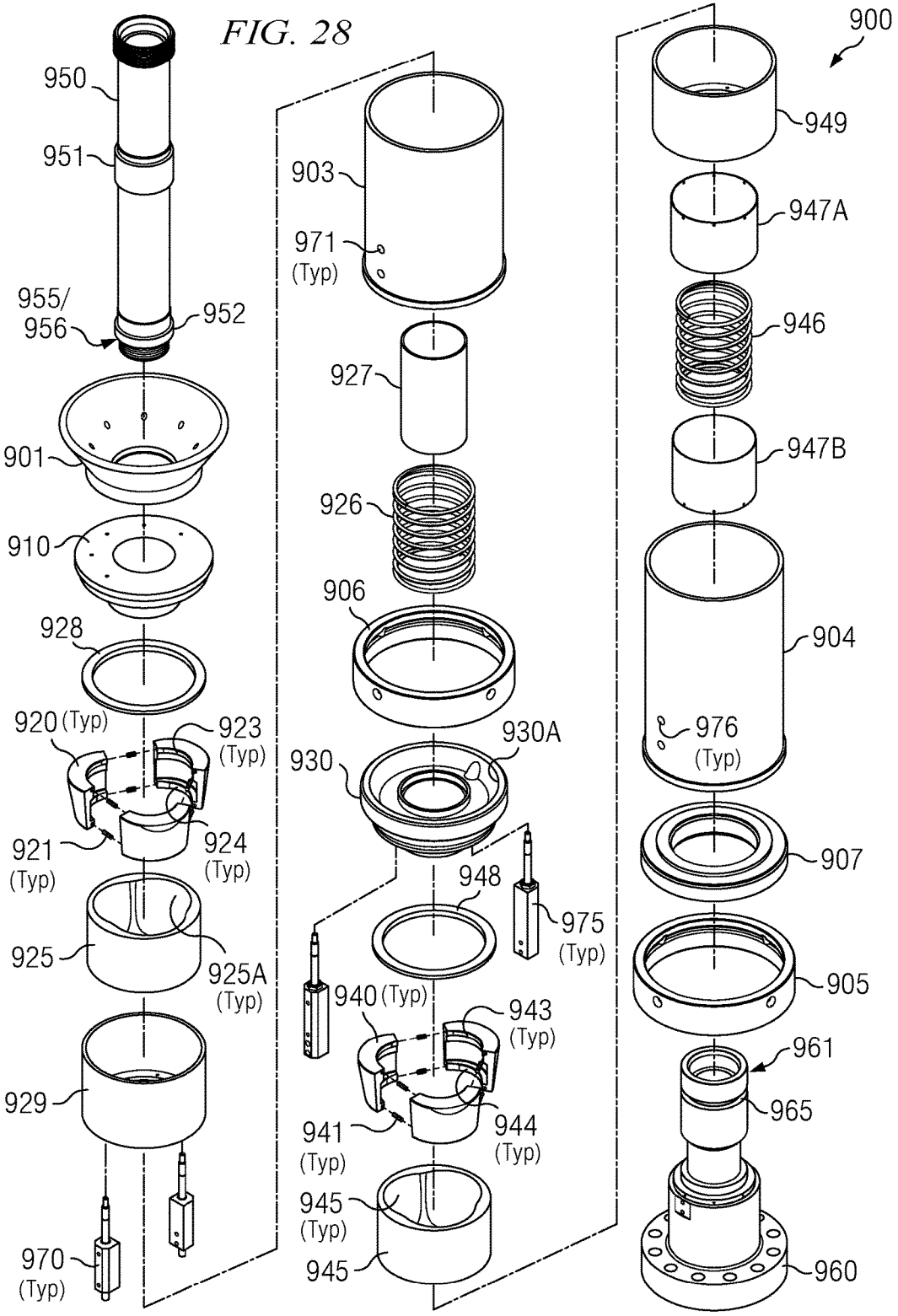

Turning now to FIGS. 25 through 28, wedge seal assembly 900 is illustrated for providing a high pressure seal for wellhead pressure control fittings. FIGS. 25 through 28 should be viewed together. FIG. 25 is an isometric section view of wedge seal assembly 900, and FIG. 28 is an exploded view of FIG. 25. FIG. 25 depicts wedge seal assembly 900 in the locked position. FIGS. 26A and 26B are freeze-frame views of wedge seal assembly 900 in partial section at the upper end, illustrating engagement of upper adapter rib 951 on adapter 950. FIG. 26A illustrates wedge seal assembly 900 in its unlocked position prior to engagement of upper adapter rib 951 and FIG. 26B illustrates wedge seal assembly 900 in its locked position over upper adapter rib 951. FIGS. 27A and 27B are freeze-frame views of wedge seal assembly 900 in partial section at the lower end, illustrating engagement of lower adapter rib 952 on adapter 950. FIG. 27A illustrates wedge seal assembly 900 in its unlocked position prior to engagement of lower adapter rib 952 and FIG. 27B illustrates wedge seal assembly 900 in its locked position over lower adapter rib 952. For clarity on FIGS. 25 through 28, and to reduce clutter on the drawings, conventional sealing parts such as o-rings are either shown but not called out as separate parts, or are omitted altogether. Further, not all parts on wedge seal assembly 900 are shown on freeze-frame FIGS. 26A through 27B. Some parts have been omitted for clarity on FIGS. 26A through 27B so that the unlocking and locking mechanisms of wedge seal assembly 900 can be appreciated more clearly.

By way of introduction to wedge seal assembly 900 in more detail, FIGS. 27A and 27B illustrate that the high pressure seal between adapter 950 and receptacle 960 is functionally analogous to the high pressure seal between adapter 250 and receptacle 260 described above with reference to FIGS. 8 through 10. Referring to FIGS. 27A and 27B, adapter 950 provides machined surfaces on seat surface 955 and slope surface 956. Receptacle 960 also provides corresponding machined surfaces shaped to match seat surface 955 and slope surface 956 at a first (distal) end 961 thereof. It will be appreciated that analogous to FIGS. 8 through 10 as described above for pressure control assembly 200, compression of adapter 950 into receptacle 960 on wedge seal assembly 900 as depicted on FIGS. 27A and 27B enables a machined surface metal-to-metal seal at seat surface 955 and slope surface 956.

A primary distinction between the embodiment of wedge seal assembly 900 (as depicted on FIGS. 27A and 27B) over the embodiment of pressure control assembly 200 (as depicted on FIGS. 8 through 10) arises in the mechanism by which wedge seal assembly 900 compresses adapter 950 into receptacle 960 to form a high pressure seal. With reference first to FIG. 27B, when adapter 950 is received into seal engagement with receptacle 960, lower adapter rib 952 is presented for engagement with lower wedge 940. Lower wedge 940 provides lower wedge top and bottom ribs 943 and 944. Hydraulic fluid is introduced to actuate and extend lower piston 975, as denoted by the large arrow on FIG. 27B. Extension of lower piston 975 causes movement of lower wedge receptacle 945 in the direction of the small vertical arrows on FIG. 27B (i.e., in a direction away from the wellhead), assisted by the bias of lower compression spring 946. This movement of lower wedge receptacle 945 compresses lower wedge 940 radially against the engagement of adapter 950 and receptacle 960, in the direction of the small horizontal arrows on FIG. 27B. Lower wedge top rib 943 locks over lower adapter rib 952 and lower wedge bottom rib 944 locks into wedge groove 965 provided in receptacle 960.

Referring now to FIG. 27A, the release of the high pressure seal enabled by wedge seal assembly 900 is substantially the reverse of the disclosure immediately above describing FIG. 27B. Hydraulic fluid is released to retract lower piston 975. Retraction of lower piston 975 causes movement of lower wedge receptacle 945 in the direction of the small vertical arrows on FIG. 27A (i.e., in a direction towards the wellhead), against the bias of lower compression spring 946. This movement of lower wedge receptacle 945 releases lower wedge 940 from its engagement of lower adapter rib 952 and wedge groove 965, in the direction of the small horizontal arrows on FIG. 27A. Adapter 950 and receptacle 960 are now free to separate, releasing the high pressure seal between them.

It will be appreciated that first from reference to FIG. 25, and then to FIGS. 26A and 26B, the high pressure seal provided by wedge seal assembly 900 is assisted by a locking mechanism further above the seal, where upper adapter rib 951 is engaged by upper wedge 920. For the avoidance of doubt, it should be understood that the engagement of upper adapter rib 951 per FIGS. 26A and 26B is not a seal, but lock that holds adapter 950 in sealing engagement with receptacle 960 as described immediately above with reference to FIGS. 27A and 27B. It will be therefore necessarily understood that in the embodiment of wedge seal assembly 900 illustrated on FIGS. 25 through 28, upper adapter rib 951 may be engaged and released by upper wedge 920 independently of the engagement and release of lower adapter rib 952 by lower wedge 940.

With reference now to FIG. 26B, when adapter 950 is received into seal engagement with receptacle 960, upper adapter rib 951 is presented for engagement with upper wedge 920. Upper wedge 920 provides upper wedge top and bottom ribs 923 and 924. Hydraulic fluid is introduced to actuate and extend upper piston 970, as denoted by the large arrow on FIG. 26B. Extension of upper piston 970 causes movement of upper wedge receptacle 925 in the direction of the small vertical arrows on FIG. 26B (i.e., in a direction away from the wellhead), assisted by the bias of upper compression spring 926. This movement of upper wedge receptacle 925 compresses upper wedge 920 radially against upper adapter rib 951, in the direction of the small horizontal arrows on FIG. 26B. Upper wedge top and bottom ribs 923 and 924 lock over upper adapter rib 951 and further restrain adapter 950 from movement relative to the high pressure seal below (seal shown on FIG. 27B).

Referring now to FIG. 26A, the release of the locking mechanism over upper adapter rib 951 is substantially the reverse of the disclosure immediately above describing FIG. 26B. Hydraulic fluid is released to retract upper piston 970. Retraction of upper piston 970 causes movement of upper wedge receptacle 925 in the direction of the small vertical arrows on FIG. 26A (i.e., in a direction towards the wellhead), against the bias of lower compression spring 946. This movement of upper wedge receptacle 925 releases upper wedge 920 from its engagement of upper adapter rib 951, in the direction of the small horizontal arrows on FIG. 26A.

Referring now to FIGS. 25 and 28, wedge seal assembly 900 comprises a generally tubular receptacle 960 that provides an exterior annular wedge groove 965 at a first end 961 thereof. A second end of receptacle 960 provides a flange or other suitable connection to a wellhead, or to equipment interposed between receptacle 960 and the wellhead. PCE adapter 950 is also generally tubular and provides a suitable connection, such as a threaded connection, to pressure control equipment (PCE) at a first end. Adapter 950 further provides a lower adapter rib 952 at a second end proximate machined seal surfaces including seat surface 955 and 956. As described above with respect to FIG. 27B, the high pressure seal between adapter 950 and receptacle 960 is functionally analogous to the high pressure seal between adapter 250 and receptacle 260 described above with reference to FIGS. 8 through 10.

Lower wedge receptacle 945 is generally cylindrical and is received over the first end 961 of receptacle 960. Lower wedges 940 are received into shaped recesses 945A in lower wedge receptacle 945 and are positioned around the first end 961 of receptacle 860. Three (3) lower wedges 940 are illustrated on FIGS. 25 and 28, although the scope of this disclosure is not limited in this regard. Lower wedges 940 are separated and kept in circumferential bias by lower wedge separator springs 941. Six (6) lower wedge separator springs 941 are illustrated on FIGS. 25 and 28, although again, the scope of this disclosure is not limited in this regard. Shaped recesses 945A and lower wedges 940 present opposing sloped surfaces such that lower wedges 940 are caused to constrict and expand radially within lower wedge receptacle 945 responsive to axial displacement of lower wedge receptacle 945 relative to lower wedges 940. Each lower wedge 940 further provides lower wedge top and bottom ribs 943 and 944. Lower wedge top rib 943 is shaped and positioned to be received over lower adapter rib 952 when adapter 950 is sealingly received into receptacle 960. Lower wedge bottom rib 944 is shaped and positioned to be received into wedge groove 965 on receptacle 960 when adapter 950 is sealingly received into receptacle 960.

Lower wedge receptacle 945 is received into lower wedge receptacle retainer 949, and lower wedge receptacle ring 948 retains lower wedge receptacle 945 in lower wedge receptacle retainer 949. Lower compression spring 946 is received over receptacle 960 and interposed between lower wedge receptacle retainer 949 and the second end of receptacle 960. Lower compression spring 946 is biased to encourage radial constriction of lower wedges 940 via axial displacement of lower wedge receptacle 945 (within lower wedge receptacle retainer 949) relative to lower wedges 940. Lower compression spring telescoping retainer sleeves 947A and 947B are received over lower compression spring 946 and also interposed between lower wedge receptacle retainer 949 and the second end of receptacle 960. Lower compression spring telescoping retainer sleeves 947A and 947B extend and retract in register with extension and retraction of lower compression spring 946.

Lower sleeve 904 is generally tubular and is received over lower wedge receptacle retainer 949, lower compression spring telescoping retainer sleeves 947A and 947B, and low compression spring 946. Lower sleeve 904 has first and second ends. The second end of lower sleeve 904 is affixed to base ring 907. Base ring 907 is affixed to the exterior of the second end of receptacle 960 by threading or other suitable connection, and lower sleeve 904 is advantageously further secured in place on base ring 907 by lower securement ring 905. The first end of lower sleeve 904 is affixed to lower roof member 930. Lower roof member 930 also contacts lower wedge top ribs 943. Lower pistons 975 are positioned in the annular space between lower sleeve 904 and lower compression spring telescoping retainer sleeves 947A and 947B, and are advantageously secured to the exterior of receptacle 960 by bolts or other suitable fasteners. Lower piston ports 976 supply and drain hydraulic fluid from lower pistons 975. Two (2) lower pistons 975 are illustrated on FIGS. 25 and 28, although the scope of this disclosure is not limited in this regard.

The cylinders of lower pistons 975 are connected to lower wedge receptacle retainer 949. As noted above in disclosure describing FIGS. 27A and 27B, extension and retraction of lower pistons 975 cause radial constriction and expansion of lower wedges 949 via displacement of lower wedge receptacle 945 (as received inside lower wedge receptacle retainer 949) with respect to lower wedges 940.

With continuing reference to FIGS. 25 and 28, upper compression spring retainer sleeve 927 is generally cylindrical and has first and second ends. The second end of upper compression spring retainer sleeve 927 is received into an interior annular recess 930A in lower roof member 930. Upper wedge receptacle retainer 929 is received over the first end of compression spring retainer sleeve 927. Upper wedge receptacle 925 is received into upper wedge receptacle retainer 929. Upper wedge receptacle ring 928 retains upper wedge receptacle 925 in upper wedge receptacle retainer 929. The first end of upper compression spring retainer sleeve 927 contacts upper wedge bottom ribs 924 on upper wedges 920.

Upper wedges 920 are also received into shaped recesses 925A in upper wedge receptacle 925. Three (3) upper wedges 920 are illustrated on FIGS. 25 and 28, although the scope of this disclosure is not limited in this regard. Upper wedges 920 are separated and kept in circumferential bias by upper wedge separator springs 921. Six (6) upper edge separator springs 921 are illustrated on FIGS. 25 and 28, although again, the scope of this disclosure is not limited in this regard. Shaped recesses 925A and upper wedges 920 present opposing sloped surfaces such that upper wedges 920 are caused to constrict and expand radially within upper wedge receptacle 925 responsive to axial displacement of upper wedge receptacle 925 relative to upper wedges 920. Each upper wedge 890 further provides upper wedge top and bottom ribs 923 and 924. Upper wedge top and bottom ribs 923 and 924 are shaped and positioned to enable upper wedges 920 to constrict around and restrain upper adapter rib 951 when adapter 950 is sealingly received into receptacle 960.

Upper compression spring 926 is received over upper compression spring retainer sleeve 927 and interposed between upper wedge receptacle retainer 929 and lower roof member 930. Upper compression spring 926 is biased to encourage radial constriction of upper wedges 920 via axial displacement of upper wedge receptacle 925 (within upper wedge receptacle retainer 929) relative to upper wedges 920.

Upper sleeve 903 is generally tabular and is received over upper wedge receptacle retainer 929 and upper compression spring 926. Upper sleeve 903 has first and second ends. The second end of upper sleeve 803 is affixed to lower roof member 930 and secured in place by upper securement ring 906. The first end of upper sleeve 903 is affixed to upper roof member 910. Upper roof member 910 also contacts upper wedge top ribs 923. Upper pistons 970 are positioned in the annular space between upper sleeve 903 and upper compression spring retainer sleeve 927, and are advantageously secured to upper sleeve 903 by bolts or other suitable fasteners. Upper piston ports 971 supply and drain hydraulic fluid from upper pistons 970. Two (2) upper pistons 970 are illustrated on FIGS. 25 and 28, although the scope of this disclosure is not limited in this regard.

The cylinders of upper pistons 970 are connected to upper wedge receptacle retainer 929. As noted above in disclosure describing FIGS. 26A and 26B, extension and retraction of upper pistons 970 cause radial constriction and expansion of upper wedges 929 via displacement of upper wedge receptacle 925 (as received inside upper wedge receptacle retainer 929) with respect to upper wedges 920.

Upper roof member 910 is affixed to tulip 801. Tulip 901 provides tulip clearance 902 sufficient to allow upper and lower adapter ribs 951 and 952 on adapter 950 to pass through tulip 901.

Earlier description made clear that the scope of this disclosure in no way limits the disclosed high pressure seal embodiments to specific sizes or models. Currently envisaged embodiments make the disclosed technology available in several sizes, shapes, and pressure ratings to adapt to existing surface pressure control equipment. Proprietary connections may require specialized adapters. It will be nonetheless understood that the scope of this disclosure is not limited to any particular sizes, shapes, and pressure ratings for various embodiments of the disclosed high pressure seal embodiments, and that the embodiments described in this disclosure and, in U.S. provisional patent application Ser. No. 62/263,889 (incorporated herein by reference) are exemplary only.

Currently envisaged embodiments of the disclosed high pressure seals may provide pressure ratings including 5,000 psi, 10,000 psi and 15,000 psi MAWP ratings, each further rated for $H_2S$ service. Currently envisaged sizes may range from about 2" to about 7" ID. The foregoing sizes and performance metrics are exemplary only, and the scope of this disclosure is not limited in such regards.

Although the disclosed high pressure seal embodiments have been described with reference to an exemplary application in pressure control at a wellhead, alternative applications could include, for example, areas such as deep core drilling, offshore drilling, methane drilling, open hole applications, hydraulic fracturing, wireline operations, coil tubing operations, mining operations, and various operations where connections are needed under a suspended or inaccessible load (i.e., underwater, hazardous area).

Exemplary materials used in the construction of the disclosed high pressure seal embodiments include high strength alloy steels, high strength polymers, and various grades of elastomers.

Although the inventive material in this disclosure has been described in detail along with some of its technical advantages, it will be understood that various changes, substitutions and alternations may be made to, the detailed embodiments without departing from the broader spirit and, scope of such inventive material as set forth in the following claims.

We claim:

1. A pressure-retaining seal, comprising:

a generally tabular adapter having first and second adapter ends, the first adapter end configured to mate with pressure-retaining equipment, the second adapter end providing an external adapter rib, the adapter rib providing an adapter sloped surface formed thereon;

a generally tubular pressure seal assembly having first and second assembly ends and a longitudinal centerline, the centerline defining (a) an axial direction parallel to the centerline and (b) radial directions perpendicular to the centerline;

the first assembly end providing a seal receptacle for receiving the second adapter end, the second adapter end and the seal receptacle further each providing cooperating abutment surfaces, the cooperating abutment surfaces forming a pressure seal between the second adapter end and the seal receptacle when the second adapter end is received into the seal receptacle; and a wedge assembly, the wedge assembly configured to engage both the second adapter end and the first assembly end when the second adapter end is received into the seal receptacle, the wedge assembly including at least one wedge surface for engagement with the adapter sloped surface;

wherein, when the second adapter end is received into the seal receptacle, constriction of the wedge assembly towards the centerline engages the at least one wedge surface onto the adapter sloped surface so as to restrain the adapter from axial displacement relative to the seal receptacle.

2. The pressure-retaining seal of claim 1, in which the second adapter end provides at least one o-ring seal configured to mate with the seal receptacle when the second adapter end is received into the seal receptacle.

3. The pressure-retaining seal of claim 2, in which:

(A) the first assembly end provides a first assembly end interior and a first assembly end exterior;

(B) the at least one o-ring seal provided by the second adapter end comprises at least first and second o-ring seals; and (C) the first assembly end further provides a quick test port, the quick test port comprising a fluid passageway from the first assembly end exterior through to the first assembly end interior, wherein the quick test port is open to the first assembly end interior at a location selected to lie between the first and second o-ring seals when the second end adapter and the receptacle form the pressure seal.

4. The pressure-retaining seal of claim 1, in which the cooperating abutment surfaces include a machined shoulder surface and a machined slope surface provided on the second adapter end, the receptacle further providing machined surfaces to mate with the machined shoulder surface and the machined slope surface on the second adapter end in forming the pressure seal.

5. The pressure-retaining seal of claim 1, in which the adapter is interchangeable with a generally tubular night cap adapter, the night cap adapter having first and second night cap ends, wherein the first night cap end is closed and the second night cap end is dimensionally identical to the second adapter end on the adapter.

6. A pressure-retaining seal, comprising:

a generally tubular adapter having first and second adapter ends, the first adapter end configured to mate with pressure-retaining equipment, the second adapter end providing an external adapter rib, the adapter rib providing an adapter sloped surface formed thereon;

a generally tubular pressure seal assembly having first and second assembly ends and a longitudinal centerline, the centerline defining (a) an axial direction parallel to the centerline and (b) radial directions perpendicular to the centerline;

the first assembly end providing a seal receptacle for receiving the second adapter end, the second adapter end and the seal receptacle further each providing cooperating abutment surfaces, the cooperating abutment surfaces forming a pressure seal between the second adapter end and the seal receptacle when the second adapter end is received into the seal receptacle; and a wedge assembly, the wedge assembly configured to engage both the second adapter end and the first assembly end when the second adapter end is received into the seal receptacle, the wedge assembly, including at least one wedge surface for engagement with the adapter sloped surface;

wherein, when the second adapter end is received into the seal receptacle, constriction of the wedge assembly towards the centerline engages the at least one wedge surface onto the adapter sloped surface so as to compress the cooperating abutment surfaces together.

7. The pressure-retaining seal of claim 6, in which the second adapter end provides at least one o-ring seal configured to mate with the seal receptacle when the second adapter end is received into the seal receptacle.

8. The pressure-retaining seal of claim 7, in which:

(A) the first assembly end provides a first assembly end interior and a first assembly, end exterior;

(B) the at least one seal provided by the second adapter end comprises at least first and second o-ring seals; and (C) the first assembly end further provides a quick test port, the quick test port comprising a fluid passageway from the first assembly end exterior through to the first assembly end, interior, wherein the quick test port is open to the first assembly end interior at a location selected to lie between the first and second o-ring seals when the second end adapter and the receptacle form the pressure seal.

9. The pressure-retaining seal of claim 6, in which the cooperating abutment surfaces include a machined shoulder surface and a machined slope surface provided on the second adapter end, the receptacle further providing machined surfaces to mate with the machined shoulder surface and the machined slope surface on the second adapter end in forming the pressure seal.

10. The pressure-retaining seal of claim 6, in which the adapter is interchangeable with a generally tubular night cap adapter, the night cap adapter having first and second night cap ends, wherein the first night cap end is closed and the second night cap end is dimensionally identical to the second adapter end on the adapter.

* * * * *